US007946569B2

(12) United States Patent
Suzuki et al.

(10) Patent No.: US 7,946,569 B2
(45) Date of Patent: May 24, 2011

(54) SHEET ALIGNING DEVICE, SHEET PROCESSING DEVICE, AND IMAGE FORMING APPARATUS

(75) Inventors: Nobuyoshi Suzuki, Tokyo (JP); Masahiro Tamura, Kanagawa (JP); Shuuya Nagasako, Kanagawa (JP); Kazuhiro Kobayashi, Kanagawa (JP); Makoto Hidaka, Tokyo (JP); Hitoshi Hattori, Tokyo (JP); Shohichi Satoh, Kanagawa (JP); Akira Kunieda, Tokyo (JP); Hiroshi Maeda, Aichi (JP); Tomoichi Nomura, Aichi (JP); Ichiro Ichihashi, Aichi (JP)

(73) Assignee: Ricoh Company, Limted, Tokyo (JP)

( * ) Notice: Subject to any disclaimer, the term of this patent is extended or adjusted under 35 U.S.C. 154(b) by 421 days.

(21) Appl. No.: 11/896,723

(22) Filed: Sep. 5, 2007

(65) Prior Publication Data

US 2008/0067730 A1 Mar. 20, 2008

(30) Foreign Application Priority Data

Sep. 6, 2006 (JP) ..... 2006-241695

(51) Int. Cl.
*B65H 37/04* (2006.01)

(52) U.S. Cl. ..... 270/58.12; 270/32; 270/58.07; 270/58.08; 270/58.09; 270/58.11; 270/58.17; 270/58.27

(58) Field of Classification Search ..... 270/32, 270/37, 58.07, 58.08, 58.09, 58.11, 58.12, 270/58.17, 58.27; 271/226
See application file for complete search history.

(56) References Cited

U.S. PATENT DOCUMENTS

| | | | | |
|---|---|---|---|---|
| 5,382,011 | A * | 1/1995 | Tani | 270/37 |
| 6,276,677 | B1 * | 8/2001 | Hommochi et al. | 270/32 |
| 6,698,744 | B2 * | 3/2004 | Yamada et al. | 270/58.12 |
| 6,905,118 | B2 * | 6/2005 | Yamada et al. | 270/8 |
| 7,052,005 | B2 * | 5/2006 | Yamakawa et al. | 270/37 |
| 7,134,654 | B2 | 11/2006 | Yamada et al. | |
| 7,198,268 | B2 | 4/2007 | Yamada et al. | |
| 7,207,556 | B2 | 4/2007 | Saitoh et al. | |
| 7,318,584 | B2 * | 1/2008 | Kato et al. | 270/58.11 |
| 2003/0160376 | A1 * | 8/2003 | Yamada et al. | 270/58.07 |
| 2003/0215275 | A1 | 11/2003 | Tamura et al. | |
| 2004/0051228 | A1 * | 3/2004 | Kato et al. | 270/58.08 |
| 2005/0061131 | A1 | 3/2005 | Tamura et al. | |
| 2006/0022394 | A1 | 2/2006 | Tamura et al. | |

(Continued)

FOREIGN PATENT DOCUMENTS

JP 09-255216 9/1997

(Continued)

OTHER PUBLICATIONS

U.S. Appl. No. 11/510,630, filed Jun. 28, 2006, Tamura et al.

*Primary Examiner* — Leslie A Nicholson, III
(74) *Attorney, Agent, or Firm* — Harness, Dickey & Pierce, PLC

(57) ABSTRACT

A sheet aligning device includes a transport path, a movable fence, a tapping tab, and jogger fences. The transport path transports a sheet stack. The movable fence and the tapping tab align the sheet stack in a first direction in which the sheet stack is transported on the transport path. The jogger fences align the sheet stack in a direction perpendicular to the first direction on the transport path. The movable fence, the tapping tab, and the jogger fences align the sheet stack according to a plurality of aligning modes.

19 Claims, 27 Drawing Sheets

U.S. PATENT DOCUMENTS

| | | | | |
|---|---|---|---|---|
| 2006/0055100 | A1 | 3/2006 | Suzuki et al. | |
| 2006/0120784 | A1 * | 6/2006 | Iida et al. | 399/407 |
| 2006/0261544 | A1 | 11/2006 | Tamura et al. | |
| 2007/0029716 | A1 | 2/2007 | Yamada et al. | |
| 2007/0051219 | A1 | 3/2007 | Tamura et al. | |
| 2007/0052147 | A1 | 3/2007 | Tamura et al. | |
| 2007/0138726 | A1 | 6/2007 | Tamura et al. | |

FOREIGN PATENT DOCUMENTS

| | | |
|---|---|---|
| JP | 2000-118850 | 4/2000 |
| JP | 2003-073022 | 3/2003 |
| JP | 2003-081512 | 3/2003 |
| JP | 3592869 | 9/2004 |

* cited by examiner

FIG. 29

| | SIZE | A3 | | | | | | A4 | | | | | |
|---|---|---|---|---|---|---|---|---|---|---|---|---|---|
| | NUMBER OF SHEETS | 1 | | 2 TO 10 | | 11 TO 20 | | 1 | | 2 TO 10 | | 11 TO 20 | |
| | THICKNESS | 0.1mm OR LESS | MORE THAN 0.1mm | 1mm OR LESS | MORE THAN 1mm | 2mm OR LESS | MORE THAN 2mm | 0.1mm OR LESS | MORE THAN 0.1mm | 1mm OR LESS | MORE THAN 1mm | 2mm OR LESS | MORE THAN 2mm |
| NUMBER-OF-ALIGNING | MODE 1 (ONCE) | ○ | | | | | | ○ | ○ | | | | |
| | MODE 2 (TWICE) | | ○ | ○ | | | | | | ○ | ○ | | |
| | MODE 3 (FIVE TIMES) | | | | ○ | ○ | | | | | | ○ | ○ |
| | MODE 4 (TEN TIMES) | | | | | | ○ | | | | | | |

FIG. 30

| | SIZE | A3 | | | | | | A4 | | | | | |
|---|---|---|---|---|---|---|---|---|---|---|---|---|---|
| | NUMBER OF SHEETS | 1 | | 2 TO 10 | | 11 TO 20 | | 1 | | 2 TO 10 | | 11 TO 20 | |
| | THICKNESS | 0.1mm OR LESS | MORE THAN 0.1mm | 1mm OR LESS | MORE THAN 1mm | 2mm OR LESS | MORE THAN 2mm | 0.1mm OR LESS | MORE THAN 0.1mm | 1mm OR LESS | MORE THAN 1mm | 2mm OR LESS | MORE THAN 2mm |
| PUSH DISTANCE | MODE 1 (0.5mm) | ○ | | | | | | ○ | ○ | | | | |
| | MODE 2 (1mm) | | ○ | ○ | | | | | | ○ | ○ | | |
| | MODE 3 (1.5mm) | | | | ○ | ○ | | | | | | ○ | ○ |
| | MODE 4 (2mm) | | | | | | ○ | | | | | | |

FIG. 31

| | SIZE | A3 | | | | | | A4 | | | | | |
|---|---|---|---|---|---|---|---|---|---|---|---|---|---|
| | NUMBER OF SHEETS | 1 | | 2 TO 10 | | 11 TO 20 | | 1 | | 2 TO 10 | | 11 TO 20 | |
| | THICKNESS | 0.1mm OR LESS | MORE THAN 0.1mm | 1mm OR LESS | MORE THAN 1mm | 2mm OR LESS | MORE THAN 2mm | 0.1mm OR LESS | MORE THAN 0.1mm | 1mm OR LESS | MORE THAN 1mm | 2mm OR LESS | MORE THAN 2mm |
| ALIGNING TASK | MODE 1 (PUSH DISTANCE: 0.5mm) (ALIGNING: ONCE) | ○ | ○ | | | | | ○ | ○ | ○ | | | |
| | MODE 2 (PUSH DISTANCE: 0.5mm) (ALIGNING: TWICE) | | | | | | | | | | ○ | ○ | |
| | MODE 3 (PUSH DISTANCE: 1mm) (ALIGNING: ONCE) | | | ○ | | | | | | | | | |
| | MODE 4 (PUSH DISTANCE: 1mm) (ALIGNING: TWICE) | | | | ○ | ○ | | | | | | | ○ |
| | MODE 5 (PUSH DISTANCE: 1mm) (ALIGNING: THREE TIMES) | | | | | | ○ | | | | | | |

SHEET ALIGNING DEVICE, SHEET PROCESSING DEVICE, AND IMAGE FORMING APPARATUS

CROSS-REFERENCE TO RELATED APPLICATIONS

The present application claims priority to and incorporates by reference the entire contents of Japanese priority document, 2006-241695 filed in Japan on Sep. 6, 2006.

BACKGROUND OF THE INVENTION

1. Field of the Invention

The present invention relates to a sheet aligning device, a sheet processing device, and an image forming apparatus.

2. Description of the Related Art

For center stapling, sheet finishers align sheets in a stapling unit and position them at the same place to staple the sheets, and convey the center-stapled sheets to a folding unit downstream. Although the maximum stapling capacity of approximately 50 sheets has been sufficient, there has been a recent demand for a stapling capacity of 100 sheets. When the stapling capacity is increased to meet the demand, staplers are also increased in size, which makes a layout of a center stapler and a center-folding mechanism difficult.

More specifically, in a conventional sheet finisher with a stapling capacity of 50 sheets, as described above, the center stapler is positioned in the stapling unit, and stapling can be performed on sheets by aligning the sheets with a jogger fence, which is commonly used for both edge stapling and center stapling. The shared use of the jogger fence is allowed thanks to a conveyance capacity of 50 sheets, corresponding the maximum stapling capacity, through between a clincher and a driver (distance set for the clearance between the clincher and the driver is 15 millimeters) of the center stapler.

Such a sheet finisher is described in, for example, Japanese Patent Application Laid-open Nos. H10-181987, 2000-118850, and 2003-073022.

When the center stapler is positioned in a stapling unit having a stapling capacity of 100 sheets as in the case of a stapling unit having a stapling capacity of 50 sheets, it is physically impossible to convey 100 sheets, corresponding to the maximum stapling capacity, through clearance space between the clincher and the driver of the center stapler. Thus, the sheets cause jam by blocking the clearance space. Meanwhile, when a stack of sheets is aligned in the stapling unit as performed in the conventional device, because the width of a jogger fence of the conventional stapling unit is set for the maximum stapling capacity, i.e., 50 sheets, a large space allowance is produced. The large space allowance sometimes causes the sheets to flutter, and stapling positions to vary. In other words, due to the large space allowance, control against curling or bending of the sheets sometimes fails, which also causes stapling at an intended position to fail.

SUMMARY OF THE INVENTION

It is an object of the present invention to at least partially solve the problems in the conventional technology.

According to an aspect of the present invention, a sheet aligning device includes a transport path that transports sheets; a first aligning unit that aligns the sheets in a first direction in which the sheets are transported on the transport path; a second aligning unit that aligns the sheets in a second direction perpendicular to the first direction on the transport path; and a mode control unit that switches aligning modes in which the first aligning unit and the second aligning unit align the sheets.

According to another aspect of the present invention, a sheet processing device includes a sheet aligning device including a transport path that transports sheets; a first aligning unit that aligns the sheets in a first direction in which the sheets are transported on the transport path; a second aligning unit that aligns the sheets in a second direction perpendicular to the first direction on the transport path; and a mode control unit that switches aligning modes in which the first aligning unit and the second aligning unit align the sheets. The sheet processing device further includes a stapling unit that is located on the transport path for stapling the sheets.

According to still another aspect of the present invention, an image forming apparatus includes a sheet aligning device including a transport path that transports sheets; a first aligning unit that aligns the sheets in a first direction in which the sheets are transported on the transport path; a second aligning unit that aligns the sheets in a second direction perpendicular to the first direction on the transport path; and a mode control unit that switches aligning modes in which the first aligning unit and the second aligning unit align the sheets.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 29 is a table of an example of modes based on the number of aligning operations;

FIG. 30 is a table of an example of modes based on push distance; and

FIG. 31 is a table of an example of modes based on aligning task.

DETAILED DESCRIPTION OF THE PREFERRED EMBODIMENTS

Exemplary embodiments of the present invention are explained in detail below referring to the accompanying drawings.

Figure 1:
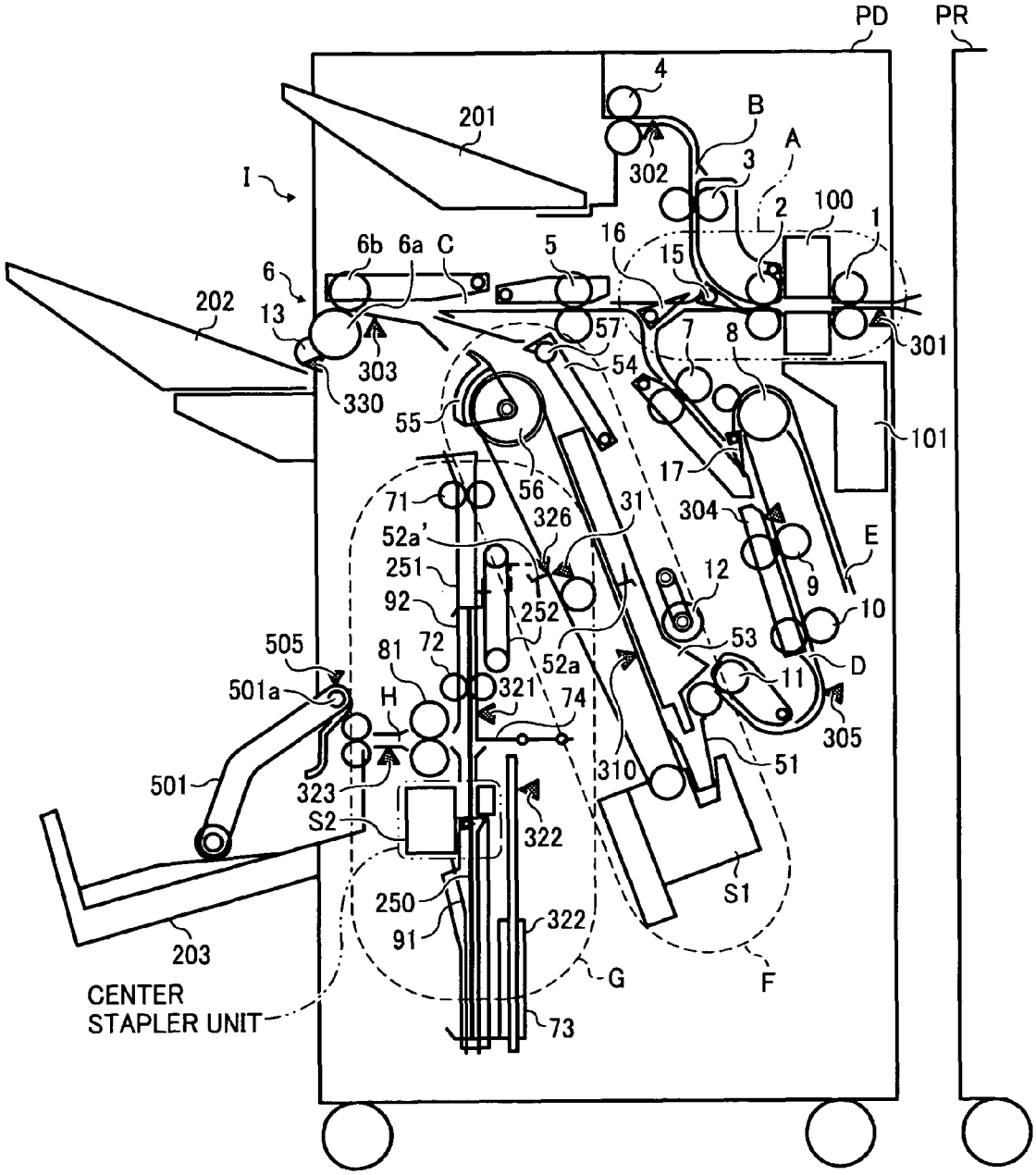
FIG. 1 is a schematic diagram of an image forming apparatus that includes a sheet processing device according to an embodiment of the present invention.

FIG. 1 is a schematic diagram of an image forming apparatus PR including a sheet processing device according to an embodiment of the present invention. The a sheet processing device is explained below as a sheet finisher PD.

As shown in FIG. 1, the sheet finisher PD is positioned at a side of the image forming apparatus PR. A recording medium (sheet) from the image forming apparatus PR is guided to the sheet finisher PD. Path-switching flaps 15 and 16 are provided to steer the sheet being conveyed on the transport path A to one of the transport path B, C, and D. The transport path A has a finishing unit (in the embodiment, a punching unit 100 serving as a perforator) that performs a finishing process on a sheet. The transport path B guides a sheet to an upper tray 201. The transport path C guides a sheet to a shift tray 202. The transport path D guides a sheet to a processing tray (hereinafter, also "stapling tray") F. In the stapling tray F, the sheet is aligned and stapled.

The sheet is conveyed via the transport paths A and D to the stapling tray F, in which the sheet is aligned and stapled, and then steered by the switching guide 54 and the movable guide 55 to either the transport paths C that guides the sheet to the shift tray 202 or the processing tray G (hereinafter, also "stapling/folding tray"), in which the sheet is subjected to folding, or the like. The sheet folded in the stapling/folding tray G is guided to the lower tray 203 via a transport path H. The transport path D includes a path-switching flap 17 that is retained in a state shown in FIG. 1 by a low load spring (not shown). When a trailing edge of a sheet has passed by the path-switching flap 17, at least a conveying roller pair 9, among the conveying roller pair 9, another conveying roller pair 10, and a discharge roller pair 11, is caused to rotate reversely so that a pre-stacking roller pair 8 guides the trailing edge of the sheet to a sheet receptacle E. The sheet is retained in the sheet receptacle E such that the sheet can be stacked with others and delivered. By repeating this operation, two or more sheets can be conveyed together in a stacked form.

The transport path A, which is upstream of and common to the transport paths B, C and D, includes, in addition to a sheet entry sensor 301, an inlet roller pair 1, the punching unit 100, a punching-waste hopper 101, a transport roller pair 2, and the path-switching flaps 15 and 16 arranged in this order downstream of the sheet entry sensor 301. The sheet entry sensor 301 detects receipt of a sheet from the image forming apparatus PR. The path-switching flaps 15 and 16 are retained in the positions shown in FIG. 1 by springs (not shown). When solenoids (not shown) are turned on, the path-switching flaps 15 and 16 rotate upward and downward, respectively, thereby steering a sheet to one of the transport paths B, C, and D.

To guide a sheet to the transport path B, the solenoid for the path-switching flap 15 is turned off to hold the path-switching flap 15 at the position shown in FIG. 1. To guide a sheet to the transport path C, the solenoids are turned on to rotate the path-switching flaps 15 and 16 upward and downward, respectively, from the position shown in FIG. 1. To guide a sheet to the transport path D, the solenoid for the path-switching flap 16 is turned off to hold the path-switching flap 16 at the position shown in FIG. 1, and the solenoid for the path-switching flap 15 is turned on to rotate the path-switching flap 15 upward from the position shown in FIG. 1.

The paper finishing device is capable of performing punching (using the punch unit 100), aligning and edge stapling (using jogger fences 53 and the edge stapler S1), a combination of aligning and center stapling (using the jogger fence 53 and a center stapler S2), sorting (using the shift tray 202), and a combination of aligning, center stapling, and center folding (using an upper jogger fence 250*a* and a lower jogger fence 250*b*, the center stapler unit, the folding plate 74, and the folding roller pair 81), and the like.

Figure 2:
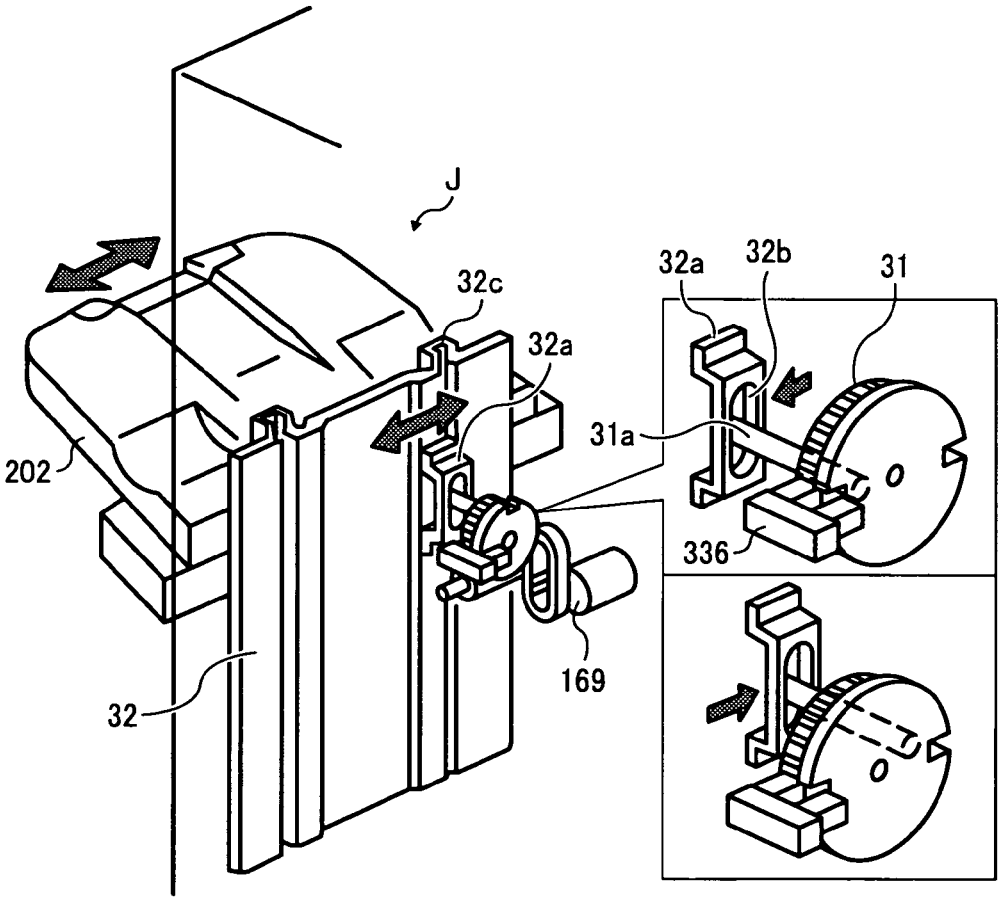
FIG. 2 is an enlarged perspective view of relevant parts of a shifting mechanism of the sheet finisher.
Figure 3:
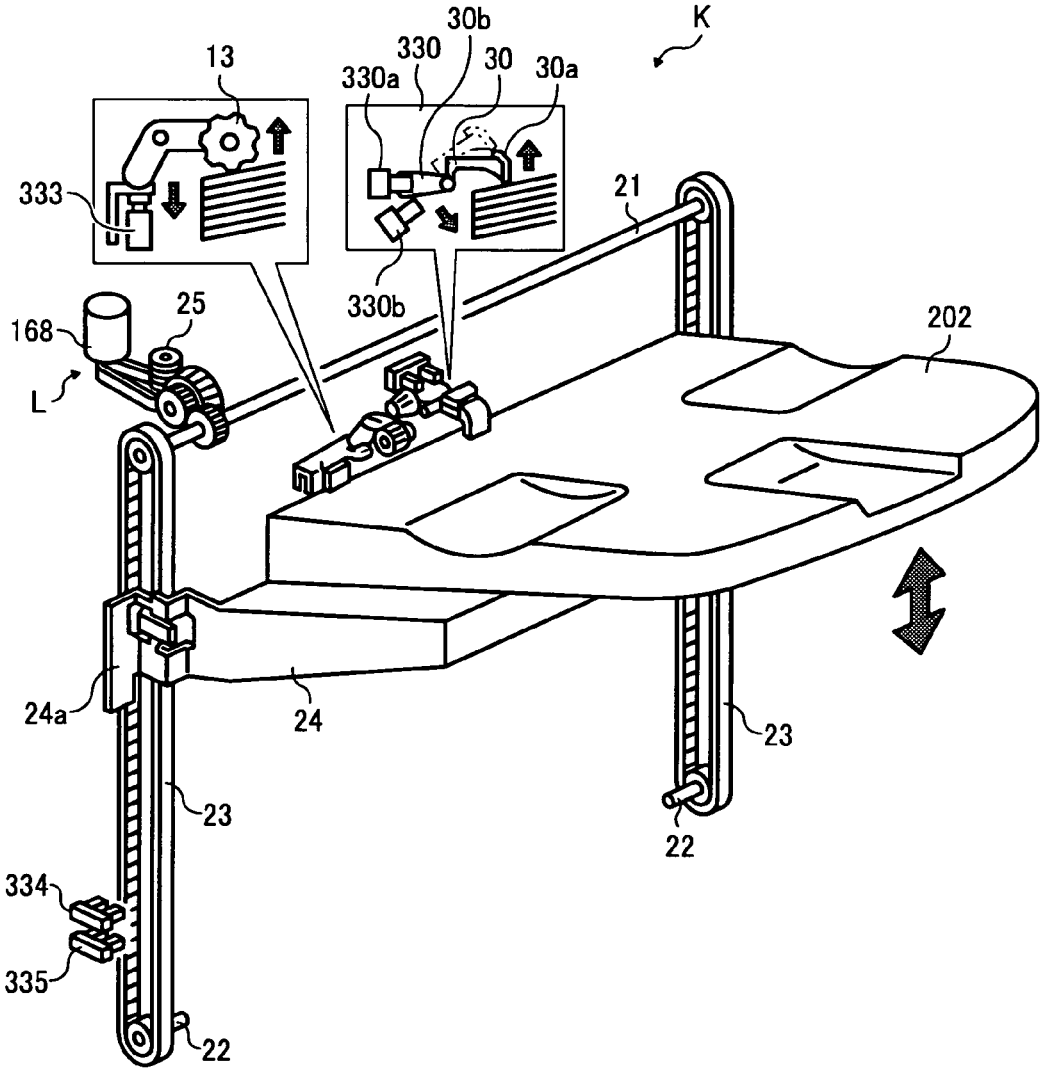
FIG. 3 is an enlarged perspective view of relevant parts of a shift-tray elevating mechanism of the sheet finisher.

FIG. 2 is an enlarged perspective view of relevant parts of a shifting mechanism J. FIG. 3 is an enlarged perspective view of relevant parts of a shift-tray elevating mechanism K. A discharge unit I positioned most downstream of the sheet finisher PD includes a discharge roller pair 6, a return roller 13, a sheet level sensor 330, the shift tray 202, the shifting mechanism J, and the shift-tray elevating mechanism K.

In FIGS. 1 and 3, the return roller 13 formed of sponge comes into contact with a sheet delivered from the discharge roller pair 6 to cause the sheet to abut at its trailing edge against an end fence 32 shown in FIG. 2, thereby aligning the sheet. The return roller 13 is rotated by torque of the discharge roller pair 6. A tray-ascending limit switch 333 is positioned near the return roller 13. When the shift tray 202 ascends and lifts the return roller 13 up, the tray-ascending limit switch 333 is turned on to stop a tray elevating motor 168. Thus, the shift tray 202 is prevented from overrunning. As shown in FIG. 1, the sheet level sensor 330 that detects a level of a sheet or a sheet stack delivered onto the shift tray 202 is positioned near the return roller 13.

As specifically shown in FIG. 3, rather than in FIG. 1, the sheet level sensor 330 includes a sheet-level detecting lever 30, a sheet level sensor (for sheets to be stapled) 330*a*, and a sheet level sensor (for sheets not to be stapled) 330*b*. The sheet-level detecting lever 30 is rotatable about its lever portion, and includes a contacting portion 30*a* and a sector shielding portion 30*b*. The sheet-level detecting lever 30 comes into contact with an upper rear end face of a sheet stacked on the shift tray 202 at the contacting portion 30*a*. The sheet level sensor (for sheets to be stapled) 330*a* is mainly used to control sheet output for stapling, and located at a higher position the sheet level sensor (for sheets not to be stapled) 330*b* that is mainly used to control sheet output for offsetting.

In the embodiment, upon being shielded by the sector shielding portion 30*b*, each of the sheet level sensor (for sheets to be stapled) 330*a* and the sheet level sensor (for sheets not to be stapled) 330*b* is turned on. Thus, when the shift tray 202 ascends to rotate the contacting portion 30*a* of the sheet-level detecting lever 30 upward, the sheet level sensor (for sheets to be stapled) 330*a* is turned off. When the shift tray 202 further rotates the contacting portion 30*a*, the sheet level sensor (for sheets not to be stapled) 330*b* is turned on. When the sheet level sensor (for sheets to be stapled) 330*a* and the sheet level sensor (for sheets not to be stapled) 330*b* detect that a sheet stack height has reached a predetermined value, the tray elevating motor 168 is driven to lower the shift tray 202 by a predetermined distance. Thus, the shift tray 202 is maintained at an essentially constant stack height.

The elevating mechanism of the shift tray 202 is described in detail below. As shown in FIG. 3, a drive unit L drives a drive shaft 21, thereby causing the shift tray 202 to ascend or descend. Timing belts 23 are wound around the drive shaft 21 and a driven shaft 22 under tension via timing pulleys. A side plate 24 that supports the shift tray 202 is fixed to the timing belts 23. In this configuration, the entire shift elevating mechanism K including the shift tray 202 is supported by the timing belts 23 to be movable up and down.

The drive unit L includes the tray elevating motor 168 serving as a drive source that can run reversely, and a worm gear 25. Torque generated by the tray elevating motor 168 is transmitted to the last gear of a gear train fixed to the drive shaft via the worm gear 25 to move the shift tray 202 upward or downward. Because the power is transmitted through the worm gear 25, the shift tray 202 can be maintained at a fixed position. Thus, the gear structure prevents unintentional dropping of the shift tray 202, and the like.

A shield plate 24*a* is formed integrally with the side plate 24 of the shift tray 202. A full-stack sensor 334 that detects a fully-stacked state of the shift tray 202 and a lower limit sensor 335 that detects a lower limit level of the shift tray 202 are positioned below the shield tray 24. The shield plate 24*a* turns on and off the full-stack sensor 334 and the lower limit sensor 335. Each of the full-stack sensor 334 and the lower limit sensor 335 is embodied by a photosensor, and turned off upon being shielded by the shield plate 24*a*. Meanwhile, the discharge roller pair 6 is not shown in FIG. 3.

As shown in FIG. 2, the shifting mechanism J includes a shift motor 169 and a shift cam 31. When the shift motor 169 rotates the shift cam 31, the shift tray 202 is moved back and forth in a direction perpendicular to a sheet output direction. A pin 31*a* is provided upright on the shift cam 31 at a position spaced from its rotary axis by a predetermined distance. A distal end of the pin 31*a* is movably received in an elongate hole 32*b* formed in an engaging member 32*a* of the end fence 32. The engaging member 32*a* is fixed to a back surface (a side where the shift tray 202 is not provided) of the end fence 32, and moved back and forth in the direction perpendicular to the sheet output direction according to an angular position of the pin 31*a*. Along with this movement, the shift tray 202 is also moved in the direction perpendicular to the sheet output direction. The shift tray 202 stops at two positions: a front position and a rear position in FIG. 1 (see the enlarged view of the shift cam 31 shown in FIG. 2). Operations of the shift tray 202 related to stopping is controlled by turning on and off the shift motor 169 in response to a detection signal supplied from a shift sensor 336 when the shift sensor 336 detects a notch in the shift cam 31.

Guiding channels 32*c*, through which the shift tray 202 is guided, are provided on the front surface of the end fence 32. Rear end portions of the shift tray 202 are vertically movably received in the guiding channels 32*c*. Thus, the shift tray 202 is supported by the end fence 32 to be movable vertically, as well as back and forth in the direction perpendicular to the sheet conveying direction. The end fence 32 guides trailing edges of sheets stacked on the shift tray 202 to align the sheets at their trailing edges.

Figure 4:
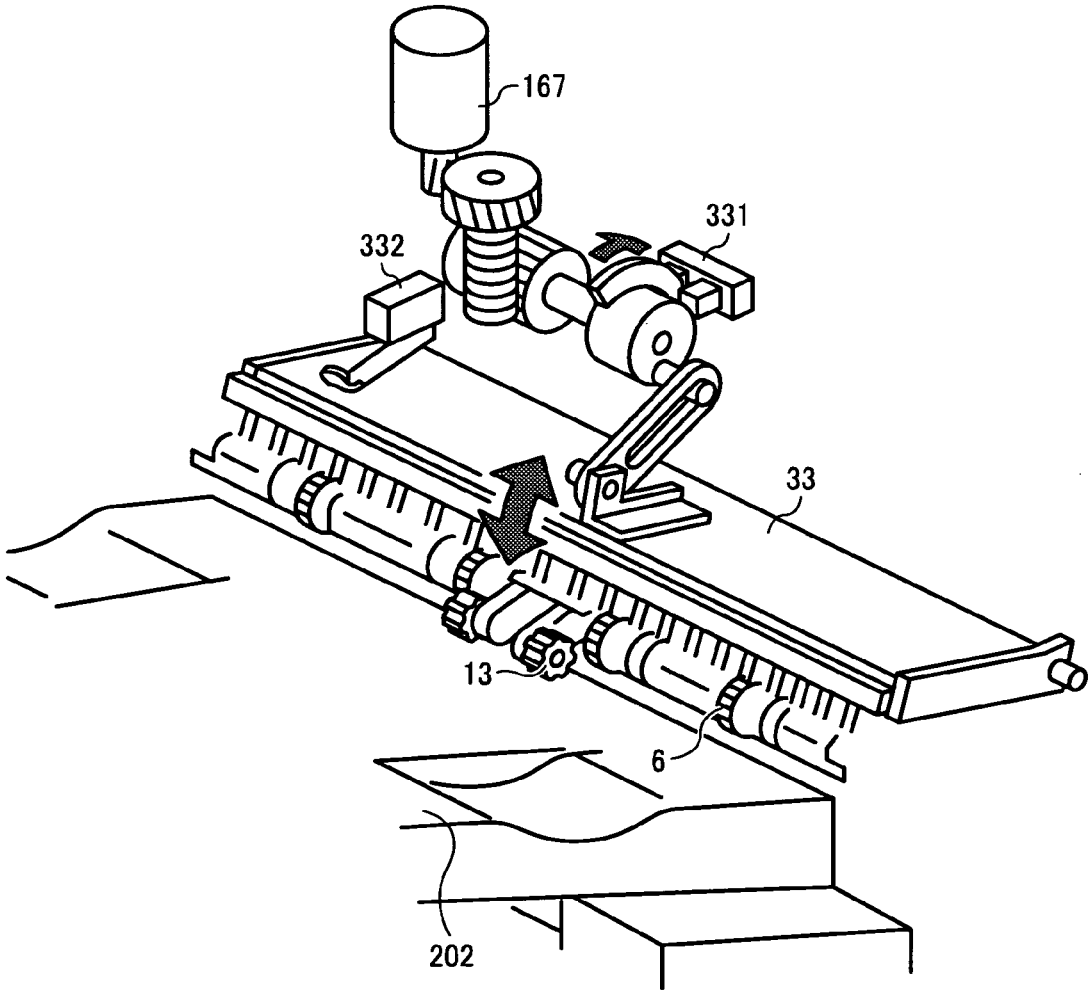
FIG. 4 is a perspective view of a discharge unit that discharges a sheet to a shift tray of the sheet finisher.

FIG. 4 is a perspective view of the discharge unit I that discharges sheets to the shift tray 202. The discharge roller pair 6 includes a drive roller 6*a* and a driven roller 6*b*. The driven roller 6*b* is supported at its upstream portion in the sheet output direction by a free end of a reclosable guide plate 33, which can pivot upward and downward. The driven roller 6*b* comes into contact with the drive roller 6*a* due to its own weight or a resilient force to deliver a sheet by nipping the sheet therebetween. To deliver a stapled sheet stack, the reclosable guide plate 33 is lifted up, and after a lapse of a predetermined period of time lowered again by a guide-plate opening/closing motor 167. The time period is determined based on a detection signal supplied from a discharge sensor 303. A position to which the reclosable guide plate 33 is lifted and held is determined based on a detection signal supplied from the guide-plate opening/closing sensor 331. A guide-plate-opening/closing limit switch 332 is turned on and off to control the guide-plate opening/closing motor 167.

Figure 5:
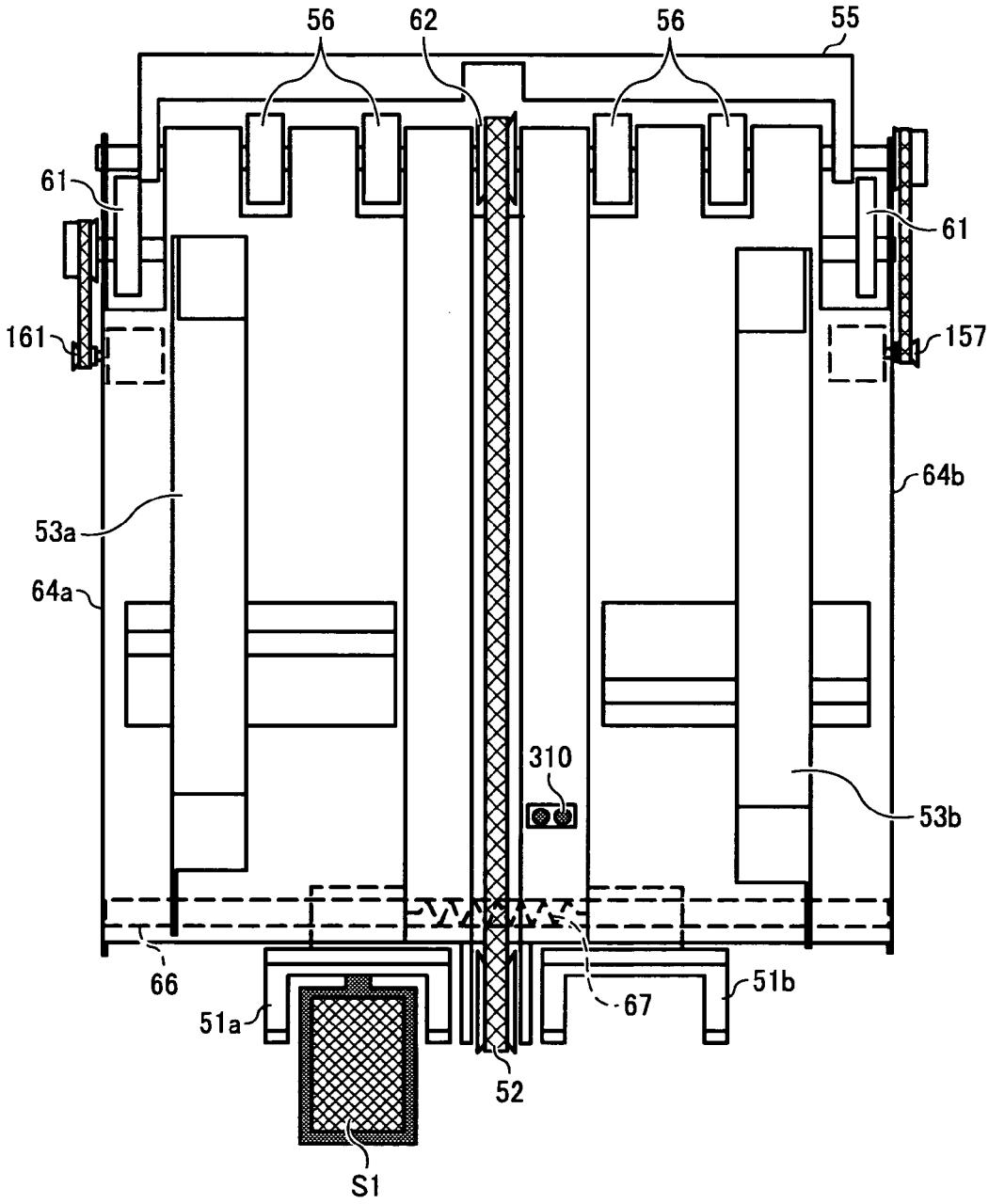
FIG. 5 is a plan view of a stapling tray of the sheet finisher as viewed from a direction perpendicular to a sheet conveying surface.
Figure 6:
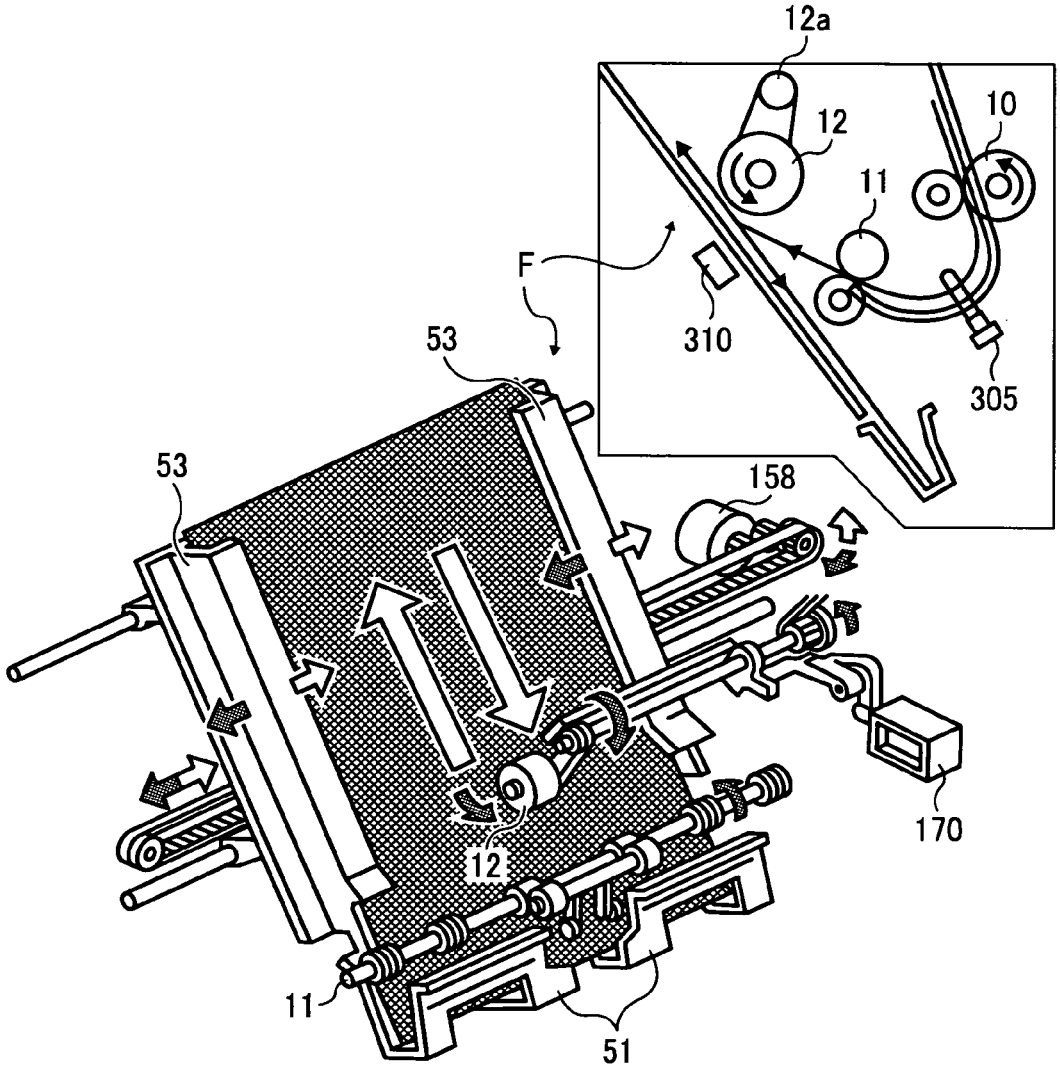
FIG. 6 is a perspective view of the stapling tray and its drive.
Figure 7:
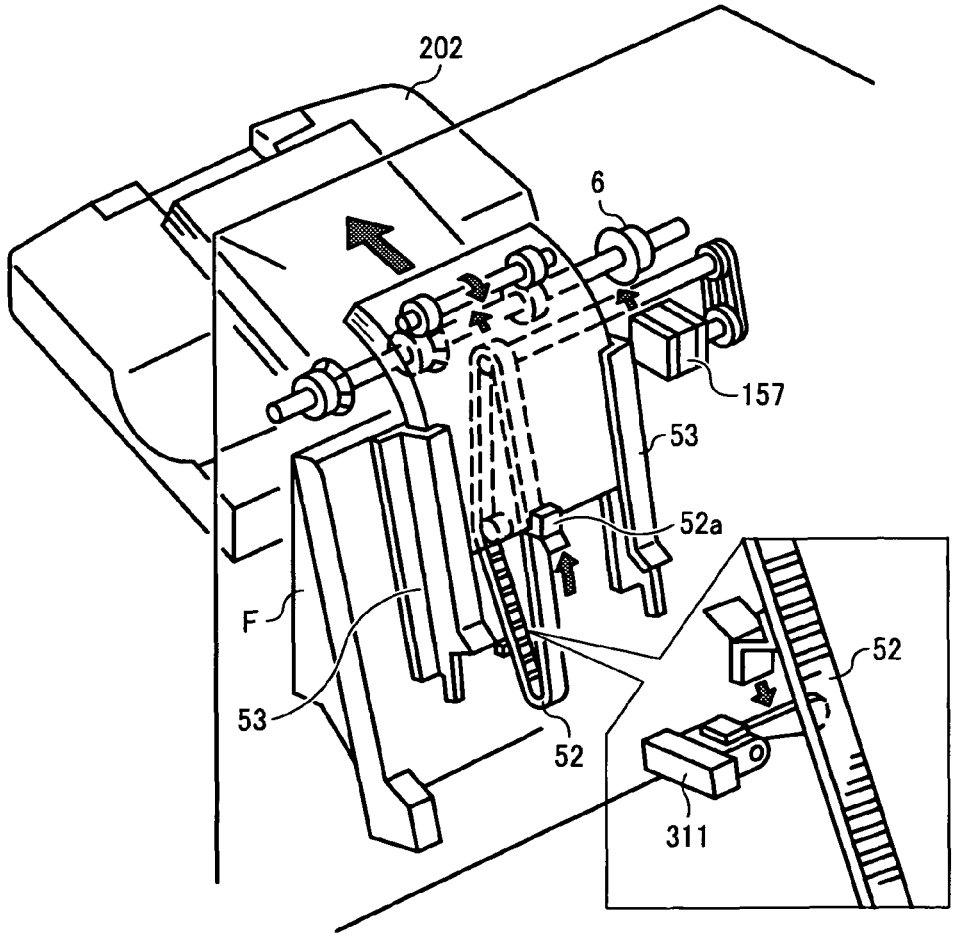
FIG. 7 is a perspective view of a sheet-stack delivery mechanism of the sheet finisher.

FIG. 5 is a plan view of the stapling tray F as viewed from a direction perpendicular to its sheet conveying face. FIG. 6 is a perspective view of the stapling tray F and its drive. FIG. 7 is a perspective view of a sheet-stack delivery mechanism. As shown in FIG. 6, first, a sheet is conveyed by the discharge roller pair 11 to the stapling tray F and sequentially stacked thereon. In the course of stacking, a tapping roller 12 taps every sheet for alignment in the vertical direction (sheet conveying direction), and simultaneously the jogger fences 53 guide the sheet to align them in the horizontal direction (direction perpendicular to the sheet conveying direction, hereinafter sometimes referred to as "sheet-width direction"). Between consecutive jobs, i.e., during an interval between conveyance of the last sheet of a sheet stack and that of the first sheet of a subsequent sheet stack, the edge stapler S1 is driven to perform stapling in response to a stapling signal supplied from a controller (see FIG. 15). Immediately after being stapled, the sheet stack is delivered to the discharge roller pair 6 via a delivery belt 52, from which with the support lug 52*a* projects, and delivered onto the shift tray 202 set at a receiving position.

As shown in FIG. 7, the support lug 52*a* turns on and off a home position (HP) sensor 311 such that the HP sensor 311 detects a home position of the support lug 52*a*. Two support lugs 52*a* and 52*a*' are positioned on the outer circumferential surface of the delivery belt 52 at oppositely spaced positions, and alternately convey sheet stacks out of the stapling tray F. It is also possible to rotate the delivery belt 52 reversely as required to align leading edges of the sheet stack housed in the stapling tray F with back surfaces of the support lug 52*a*, which is on standby for a subsequent transportation of a sheet stack, and the oppositely positioned support lug 52*a*'. Thus, the support lugs 52*a* and 52*a*' function also as a set of aligners that aligns a sheet stack in the sheet conveying direction.

As shown in FIG. 5, the delivery belt 52 and a drive pulley 62 are positioned on a drive shaft of the delivery belt 52 that is driven by a delivery motor 157 at its center in the sheet-width direction. The output rollers 56 are arranged and fixed symmetrically with respect to the drive pulley 62. The peripheral velocity of the output rollers 56 is set to be greater than that of the delivery belt 52.

As shown in FIG. 6, the tapping roller 12 is swung about a fulcrum 12*a* by a tapping solenoid (SOL) 170. The tapping roller 12 intermittently taps a sheet fed into the stapling tray F, thereby causing the sheet to abut against a trailing-edge fence 51. The tapping roller 12 rotates counterclockwise.

The jogger fences 53 (53*a* and 53*a*', see FIG. 5) driven by a jogger motor 158 that can run reversely via a timing belt moves back and forth in the sheet-width direction.

Figure 8:
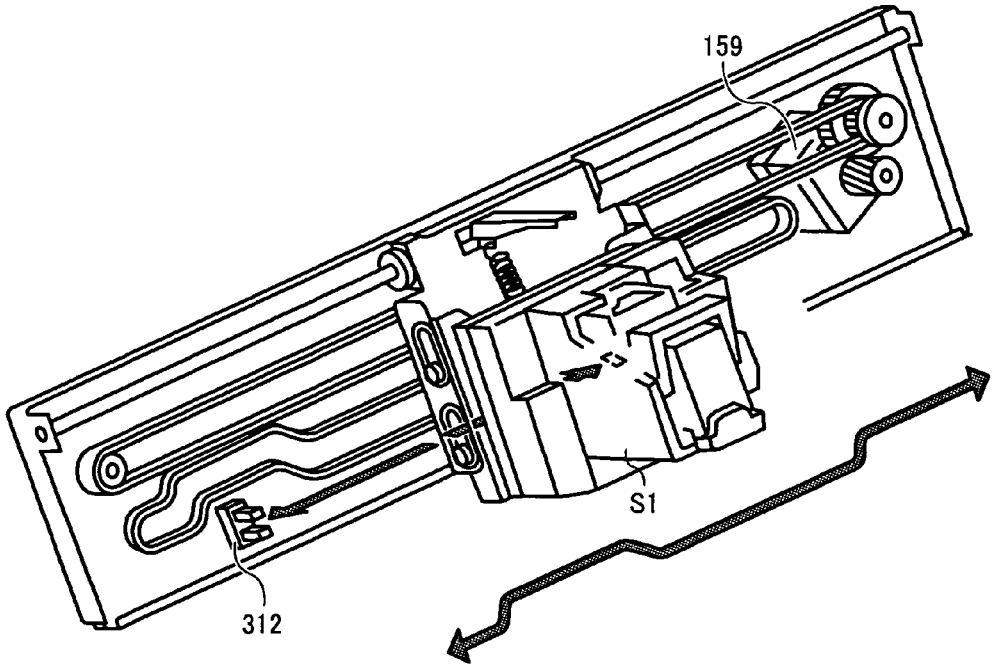
FIG. 8 is a perspective view of a edge stapler and its transfer mechanism of the sheet finisher.
Figure 9:
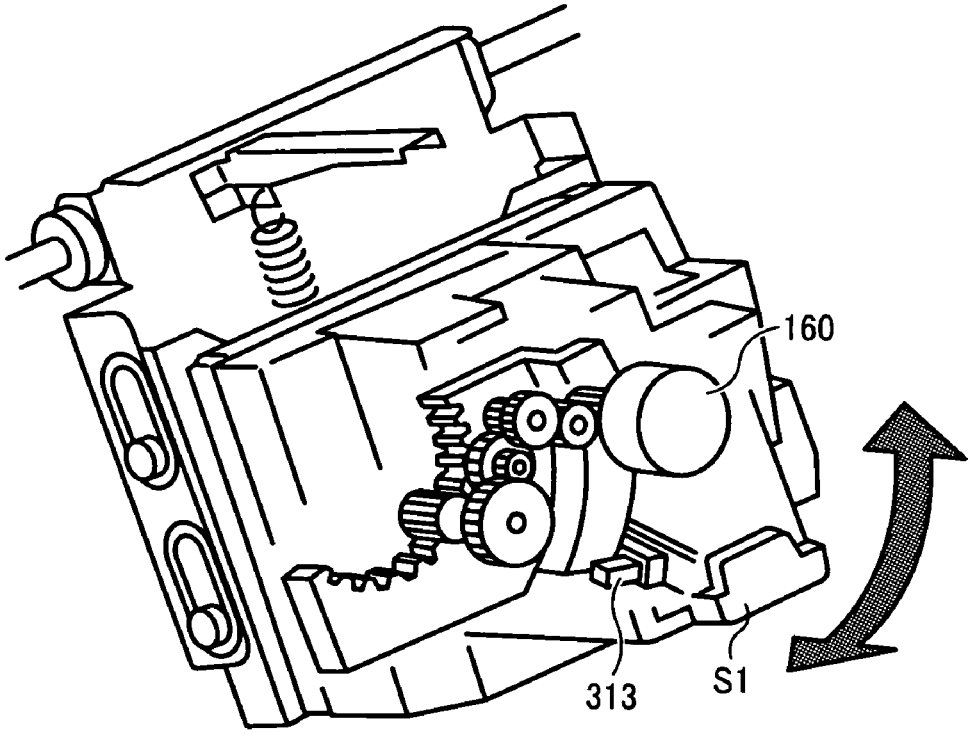
FIG. 9 is a perspective view of a mechanism that tilts or rotates the edge stapler shown in FIG. 8.

FIG. 8 is a perspective view of the edge stapler S1 and its transfer mechanism. The edge stapler S1 is driven by a stapler-moving motor 159 that can run reversely via a timing belt. The edge stapler S1 is moved in the sheet-width direction to staple a sheet stack at a desired edge position. An HP sensor 312 that detects a home position of the edge stapler S1 is positioned at a side end of the movable range of the edge stapler S1. Stapling position in the sheet-width direction is controlled based on a travel of the edge stapler S1 from the home position. As shown in FIG. 9, the edge stapler S1 is configured such that a stapling angle can be changed to be parallel to or tilt relative to an end of the sheet stack. The edge stapler S1 is also configured such that only a stapling mechanism of the edge stapler S1 can be rotated at the home position to tilt by a predetermined angle to facilitate replacement of staples. A stapler-tilting motor 160 is driven to rotate the edge stapler S1 to tilt. When an HP sensor 313 detects that the stapler S1 is tilted to reach a predetermined angle or a stapler replacement position, the stapler-tilting motor 160 is stopped. Upon completion of tilt stapling or completion of staple replacement, the edge stapler S1 is rotated to return to its home position for a subsequent stapling.

As shown in FIG. 5, constituents of the stapling tray F are between a front side plate 64*a* and a rear side plate 64*b*. One of the constituents is a sliding shaft 66. The trailing-edge fences 51 (a right fence 51*a* and a left fence 51*b* in FIG. 5) slidingly move along the sliding shaft 66. A tension spring 67 is positioned between the trailing-edge fences 51*a* and 51*b*. The tension spring 67 constantly urges the trailing-edge fences 51*a* and 51*b* in a direction of approaching each other, thereby urging the edge stapler S1 to the home position. A sheet detecting sensor 310 determines presence/absence of a sheet on the stapling tray F.

The sheet stack stapled at its center in the stapling tray F is folded at a center portion. The sheet stack is folded at its center in the stapling/folding tray G. Thus, to be folded at its center, the sheet stack must be conveyed to the stapling/folding tray G. In the embodiment, a sheet-stack steering unit that transports the sheet stack to the stapling/folding tray G is provided at a most downstream portion of the stapling tray F in the sheet conveying direction.

Figure 10:
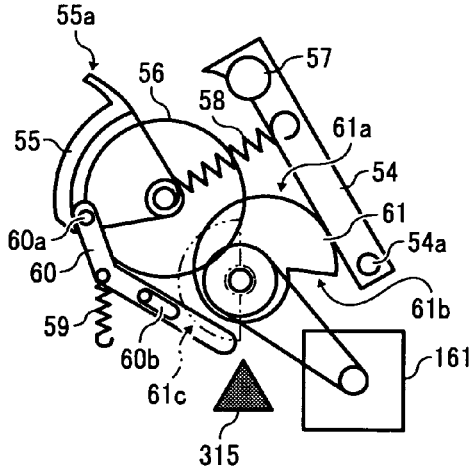
FIG. 10 is a schematic diagram for explaining a state where a sheet-stack steering unit of the sheet finisher delivers a sheet (stack) onto a shift tray.
Figure 11:
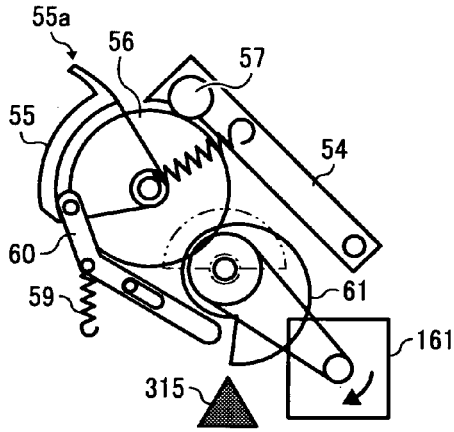
FIG. 11 is a schematic diagram for explaining a state where a switching guide rotates from a position shown in FIG. 10 toward an output roller.
Figure 12:
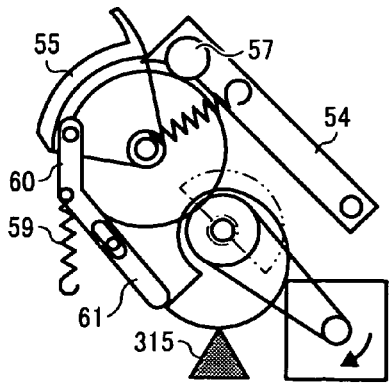
FIG. 12 is a schematic diagram for explaining a state where a movable guide rotates from a position shown in FIG. 11 toward the switching guide to form a path that guides a sheet stack toward a stapling/folding tray.
Figure 16:
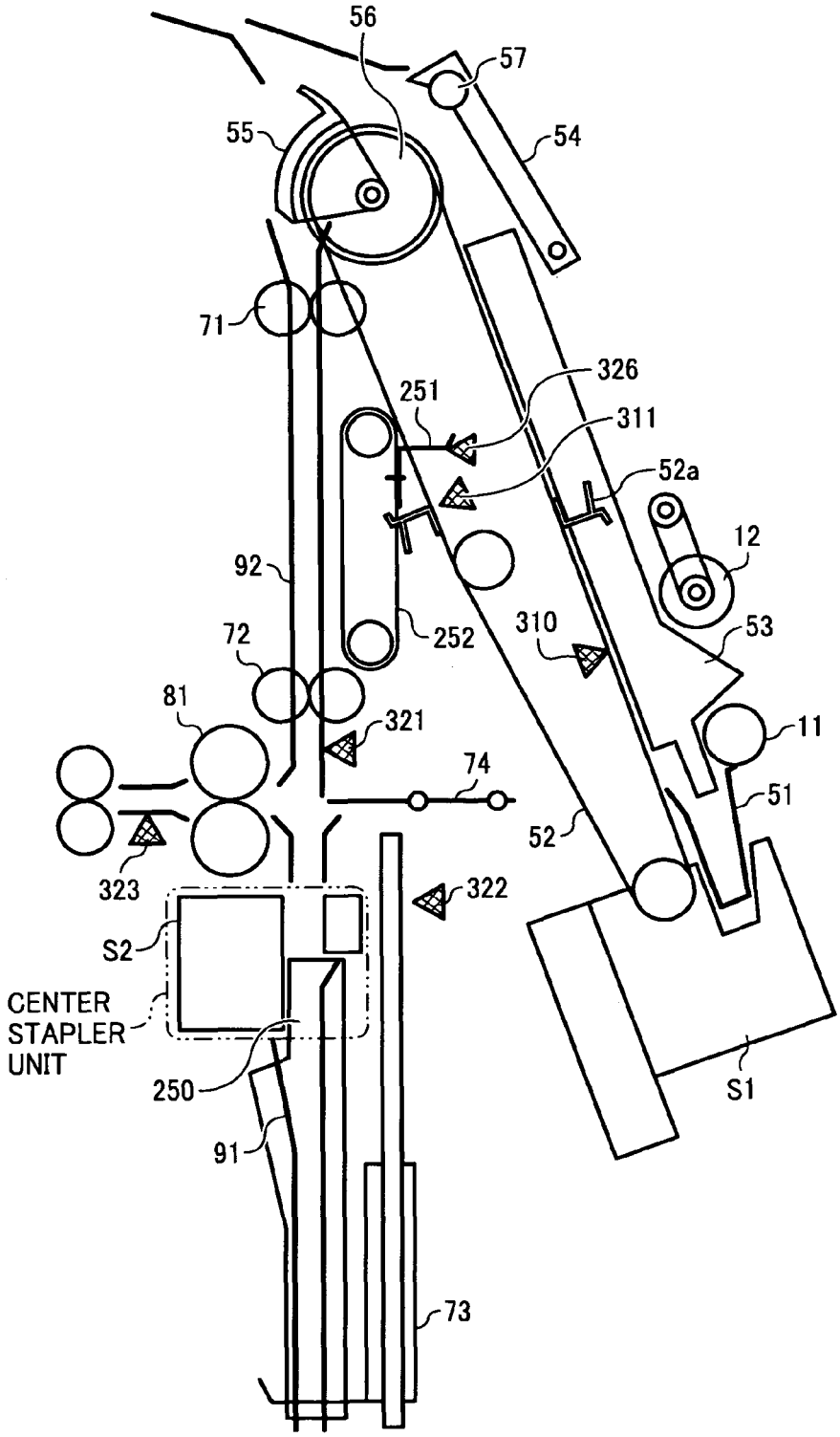
FIG. 16 is an enlarged view of the stapling tray and the stapling/folding tray.
Figure 17:
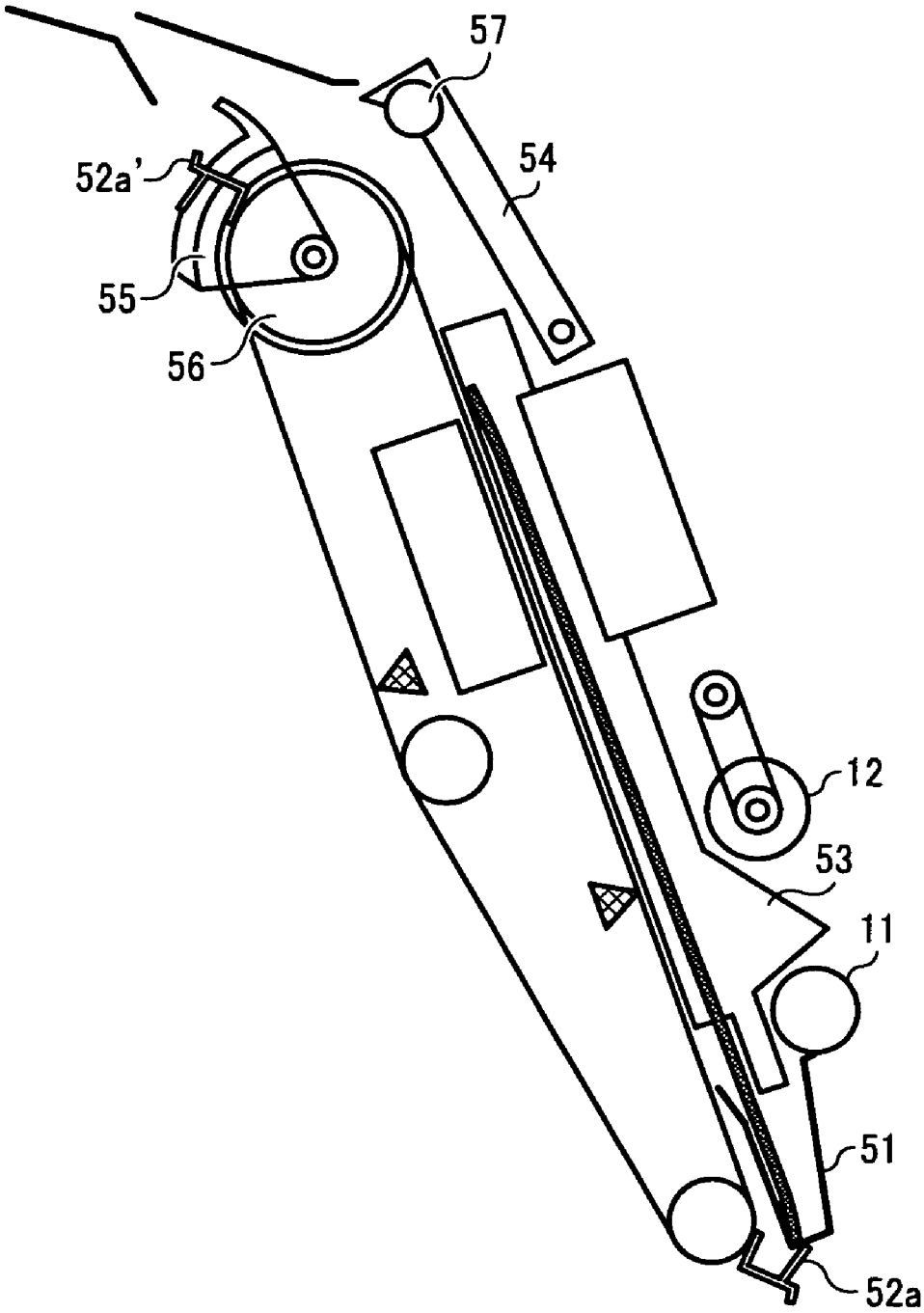
FIG. 17 is a schematic diagram for explaining aligning of a sheet stack performed in the stapling tray.

As shown in FIG. 1 and FIG. 16 depicting an enlarged view of the stapling tray F and stapling/folding tray G, the sheet-stack steering unit includes the switching guide 54 and a movable guide 55. As shown in FIGS. 10 to 12, the switching guide 54 is positioned to be upwardly and downwardly pivotable about a fulcrum 54*a*, and has a rotatable pressing roller 57 at its downstream portion. The switching guide 54 is constantly urged by a spring 58 toward the output rollers 56. The switching guide 54 comes into contact with a cam surface 61*a* of a cam 61 that is driven by a path-switching drive motor 161, which defines the position of the switching guide 54.

The movable guide 55 is pivotably supported on the rotary shaft of the output rollers 56. A link arm 60 is rotatably coupled to one end (opposite end from the switching guide 54) of the movable guide 55 via a joint 60*a*. A pin fixed to the front side plate 64*a* shown in FIG. 5 is movably received in an elongated hole 60*b* defined in the link arm 60. This limits a movable range of the movable guide 55. The link arm 60 is downwardly urged by a spring 59, thereby being retained at a position shown in FIG. 10. When the cam 61 is rotated by the path-switching drive motor 161 and a cam surface 61*b* is pushed against the link arm 60, the movable guide 55 coupled to the link arm 60 is rotated upward.

An HP sensor 315 detects a shielding portion 61*c* of the cam 61, thereby detection a home position of the cam 61. Driving pulses of the path-switching drive motor 161 are counted using the thus-detected home position as its reference so that a position at which the cam 61 is to be stopped is controlled based on the pulse count.

FIG. 10 is a schematic diagram for explaining a positional relation between the switching guide 54 and the movable guide 55 with the cam 61 at its home position. A guide surface 55*a* of the movable guide 55 serves as a guide for sheets on a transport path to the discharge roller pair 6.

FIG. 11 is a schematic diagram for explaining a state where the cam 61 is rotated to cause the switching guide 54 to pivot about the fulcrum 54*a* counterclockwise (downward), bringing a pressing roller 57 into press contact with the output rollers 56.

FIG. 12 is a schematic diagram for explaining a state where the cam 61 is further rotated to cause the movable guide 55 to pivot clockwise (upward), thereby forming a path that guides a sheet from the stapling tray F to the stapling/folding tray G with the switching guide 54 and movable guide 55. FIG. 5 depicts a depthwise positional relation among these components.

In the embodiment, both the switching guide 54 and the movable guide 55 are driven by a drive motor. As an alternative configuration, each of the switching guide 54 and the movable guide 55 can include a drive motor so that stop positions and timings, at which the guides are to be moved, can be controlled according to a sheet size and the number of sheets to be stapled.

As shown in FIG. 1, the stapling/folding tray G is provided downstream of the sheet-stack steering unit formed with the movable guide 55 and the output rollers 56. The stapling/folding tray G is positioned essentially vertically with a center-folding mechanism at its center, an upper transport-guide plate (hereinafter, "lower guide plate") 92 above the center-folding mechanism, and a lower transport-guide plate (hereinafter, "upper guide plate") 91 below the same. An upper sheet stack-transport roller pair (hereinafter, "upper transport-roller pair") 71 and a lower sheet stack-transport roller pair (hereinafter, "lower transport-roller pair") 72 are positioned above the upper guide plate 92 and below the lower guide plate 91, respectively. The jogger fences 250 are positioned on and along opposite side surfaces of the lower guide plate 91. The center stapler unit is provided at a position at which a lower one of the jogger fences 250 is positioned. The jogger fences 250 are driven by a drive mechanism (not shown) to align sheets in the direction (sheet-width direction) perpendicular to the sheet conveying direction. The center stapler unit includes two pairs of center staplers S2, each including a clincher and a driver, positioned with predetermined spacing therebetween in the sheet-width direction. While the two pairs of center staplers S2 are fixedly positioned in the embodiment, alternatively, a pair of the clincher and the driver can be positioned to be movable in the widthwise direction to perform stapling at two positions using the single pair of the clincher and the driver.

Each of the upper transport-roller pair 71 and the lower transport-roller pair 72 is formed with a drive roller and a driven roller. The upper transport-roller pair 71 includes a distance sensor that measures a distance between nip portions of the roller pair. Accordingly, when a sheet stack is nipped by the upper transport-roller pair 71, the distance between the nip portions can be detected using the distance sensor and transmitted to a central processing unit (CPU) 360. Thus, a controller 350 can acquire thickness data about the sheet stack, and the CPU 360 can perform mode selection, described later, based on the thickness data.

The movable fence 73 is positioned across the lower guide plate 91. A transfer mechanism including a timing belt and its drive allows the movable fence 73 to move in the sheet conveying direction (vertical direction in the drawings). Although not shown, the drive includes a drive pulley, a driven pulley, around which the timing belt is wound, and a stepping motor that drives the drive pulley. Similarly, the tapping tab 251 and its drive are positioned on an upper end of the upper guide plate 92. A timing belt 252 and a drive (not shown) move the tapping tab 251 back and force, i.e., in a direction separating from the sheet stack steering mechanism and a direction pressing the trailing edge of a sheet stack (corresponding to a tail end of the sheet in an orientation taken at entry to the finisher). An HP sensor 326 detects a home position of the tapping tab 251.

A center-folding mechanism is provided at or near the center of the stapling/folding tray G, and includes the folding plate 74, the folding roller pair 81, and a transport path H on which a folded sheet stack is conveyed.

Figure 13:
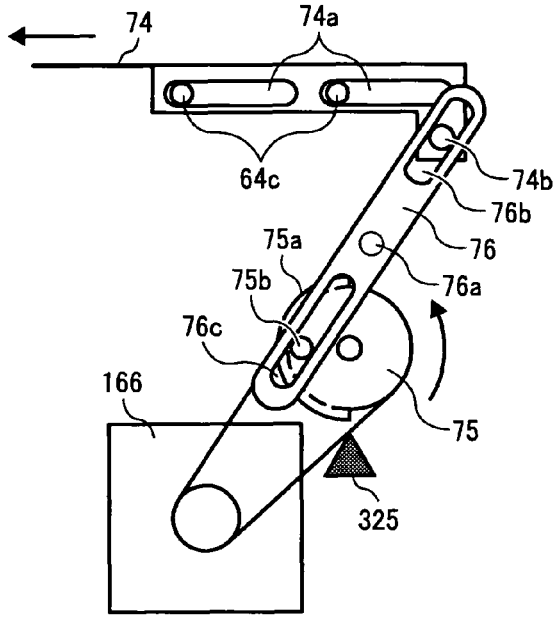
FIG. 13 is a schematic diagram for explaining the operation of a transfer mechanism for a folding plate of the sheet finisher before starting center folding.
Figure 14:
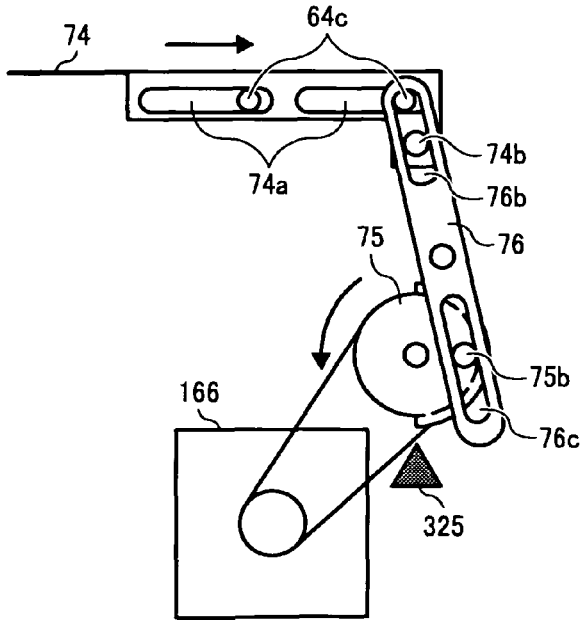
FIG. 14 is a schematic diagram for explaining a state of the transfer mechanism returning to an initial position after center folding.

FIGS. 13 and 14 are schematic diagrams for explaining the operation of a transfer mechanism of the folding plate 74 used in center folding.

Two pins 64*c* are positioned upright on the front and rear side plates 64*a* and 64*b*, and elongated holes 74*a* are defined in the folding plate 74. The elongated holes 74 movably receive a corresponding one of the two pins 64*c*, thereby supporting the folding plate 74. A pin 74*b* is positioned upright on the folding plate 74, and an elongated hole 76*b* is defined in the link arm 76. The elongated hole 76*b* movably receives the pin 74*b*, and the link arm 76 pivots about a fulcrum 76*a*, thereby allowing the folding plate 74 to move rightward and leftward in FIGS. 13 and 14.

A pin 75*b* on a folding-plate cam 75 is movably received in an elongate hole 76*c* defined in the link arm 76. Thus, rotating motion of the folding-plate drive cam 75 causes the link arm 76 to pivot, and, in response thereto, the folding plate 74 is reciprocally moved in a direction perpendicular to the lower and upper guide plates 91 and 92 in FIG. 16.

The folding-plate drive cam 75 is rotated by a folding-plate drive motor 166 in a direction indicated by arrow in FIG. 13. An HP sensor 325 detects opposite ends of a semicircular shielding portion 75*a* to determine a position at which the folding-plate drive cam 75 is to stop.

FIG. 13 depicts the folding plate 74 at its home position where the folding plate 74 is completely retreated from a sheet stack housing area in the stapling/folding tray G. Rotating the folding-plate drive cam 75 in a direction indicated by circular arrow in FIG. 13 causes the folding plate 74 to move in a direction indicated by linear arrow to project into the sheet stack housing area in the stapling/folding tray G. FIG. 14 depicts a position at which a center of the sheet stack on the stapling/folding tray G is pushed into a nip portion of the folding roller pair 81. Rotating the folding-plate drive cam 75 in a direction indicated by circular arrow in FIG. 14 causes the folding plate 74 to move in a direction indicated by linear arrow to retreat from the sheet stack housing area in the stapling/folding tray G.

While, in the embodiment, a center fold is assumed to be given to a sheet stack, the invention can be also applied to a fold of a single sheet. When a single sheet is to be folded, the center stapling is skipped. Accordingly, at an instant of being delivered, the sheet is conveyed to the stapling/folding tray G, in which the sheet is subjected to folding performed by the folding plate 74 and the folding roller pair 81, and then output to the lower tray 203. A folded-portion-passage sensor 323 detects a center-folded sheet. A sheet-stack sensor 321 detects arrival of a sheet stack at the center-fold position. A movable HP sensor 322 that detects a home position of the movable fence 73. In the embodiment, a detecting lever 501 for use in detection of a stack height of center-folded sheet stacks in the lower tray 203 is positioned to be pivotable about a fulcrum 501*a*. A sheet level sensor 505 detects an angle of the detecting lever 501, thereby detecting ascending and descending, and overflow pertaining to the lower tray 203.

Figure 15:
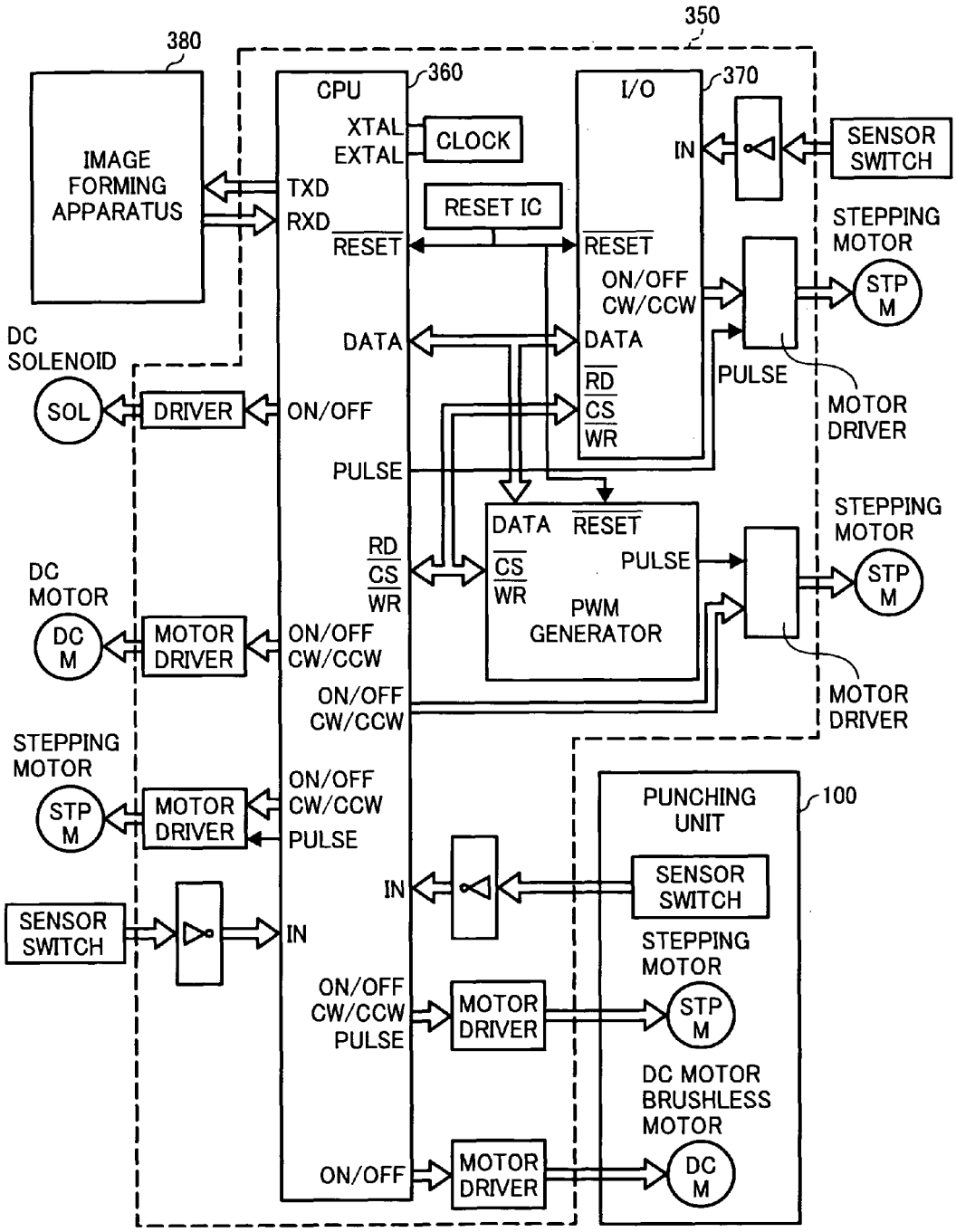
FIG. 15 is a block diagram of the control circuit of the sheet finisher and an image forming apparatus.

FIG. 15 is a block diagram of the control circuit of the sheet finisher PD and an image forming apparatus 380 such as a copier and a printer. The controller 350 is a microcomputer that includes the CPU 360, and I/O interface 370. Various switches are provided on a control panel on the image forming apparatus 380, and signals supplied from the switches and various sensors are entered to the CPU 360 via the I/O interface 370. The sensors include: the sheet entry sensor 301, a discharge sensor 302, the discharge sensor 303, a pre-stack sensor 304, a discharge sensor 305, the sheet detecting sensor 310, the HP sensor 311, the HP sensor 312, the HP sensor 313, a jogger-fence HP sensor, the HP sensor 315, the sheet-stack arrival sensor 321, the movable HP sensor 322, the folded-portion passage sensor 323, the HP sensor 325, the sheet-level sensors 330 including 330*a* and 330*b*, and the guide-plate opening/closing sensor 331.

The CPU 360 controls, based on the thus-supplied signals, a tray elevating motor 168 that lifts and lowers the shift tray 202; the guide-plate opening/closing motor 167 that opens and closes the reclosable guide plate; the shift tray motor 169 that moves the shift tray 202; a tapping roller motor (not shown) that drives the tapping roller 12; various solenoids such as the tapping SOL 170; transport motors that drives the various transport rollers; sheet-output motors that drive the various output rollers; the delivery motor 157 that drives the delivery belt 52; the stapler-moving motor 159 that moves the edge stapler S1; the stapler-tilting motor 160 that rotates the edge stapler S1 to tilt; the jogger motor 158 that moves the jogger fences 53; the path-switching drive motor 161 that rotates the switching guide 54 and the movable guide 55; a transport motor (not shown) for driving the transport rollers that convey the sheet stack; a trailing-edge fence moving motor (not shown) that moves the movable fence 73; the folding-plate drive motor 166 that moves the folding plate 74;

and a folding-roller drive motor that drives the folding roller pair 81. Pulses of a transport-to-stapler motor (not shown) that drives the discharge roller pair 11 are entered to the CPU 360. The CPU 360 counts the pulses and controls the tapping SOL 170 and the jogger motor 158 in accordance with the number of pulses.

The folding-plate drive motor 166, embodied using a stepping motor, is controlled by the CPU 360 either directly via a motor driver or indirectly via the I/O interface 370 and the motor driver. Because the CPU 360 controls a clutch and a motor of the punching unit 100 as well, perforation is performed in response to a command supplied from the CPU 360.

The CPU 360 controls the sheet finisher PD by executing programs stored in a read only memory (ROM, not shown) using a random access memory (RAM, not shown) as a working area.

Operations of the sheet finisher performed under control of the CPU 360 is described below. According to the embodiment, a sheet is output in the following finishing modes:

Non-stapling mode "a" in which a sheet stack is conveyed to the upper tray 201B via the transport paths A and B Non-stapling mode "b" in which a sheet stack is conveyed to the shift tray 202 via the transport paths A and C Sorting-and-stacking mode in which a sheet stack is conveyed to the shift tray 202 via the transport paths A and C, while the shift tray 202 is moved in a direction perpendicular to the sheet output direction alternately back or forth for every set of collated sheets, thereby offsetting each collated sheet set for easy separation;

Stapling mode, in which a sheet stack is conveyed via the transport paths A and D to the edge stapling tray F, in which the sheet stack is aligned and stapled, and thereafter conveyed to the shift tray 202 via the transport path C Center-stapling-for-booklet-production mode, in which a sheet stack is conveyed via the transport paths A and D to the edge stapling tray F, in which the sheet stack is aligned and stapled, further conveyed to the stapling/folding tray G, in which the sheet stack is folded at its center, and thereafter conveyed to the lower tray 203 via the transport path H. Each mode is described in detail below.

(1) Non-Stapling Mode "a"

A sheet stack is guided by the path-switching flap 15 from the transport path A to the transport path B, and then delivered onto the upper tray 201 by the transport roller pair 3 and a discharge roller pair 4. The discharge sensor 302 positioned near the discharge roller pair 4 detects whether a sheet stack has been output to the upper tray 201.

(2) Non-Stapling Mode "b"

A sheet stack is guided by the path-switching flaps 15 and 16 from the transport path A to the transport path C, and then delivered onto the shift tray 202 by the transport roller pair 5 and the discharge roller pair 6. The discharge sensor 303 provided near the discharge roller pair 6 detects whether a sheet stack has been output.

(3) Sorting-and-Stacking Mode

A sheet stack is conveyed and delivered in the same manner as the non-stapling mode "b." Simultaneously, the shift tray 202 is moved alternately back or forth in the direction perpendicular to the sheet output direction for every set of collated sheets, thereby offsetting each collated set for easy separation.

(4) Stapling Mode

A sheet stack is guided by the path-switching flaps 15 and 16 from the transport path A to the transport path D, and thereafter delivered onto the edge stapling tray F by the transport roller pairs 7, 9, and 10, and the discharge roller pair 11. The discharge roller pair 11 sequentially delivers sheets into the edge stapling tray F, in which the sheets are aligned. When the number of the thus-stacked sheets reaches a predetermined number, the edge stapler S1 staples the sheet stack. The thus-stapled sheet stack is conveyed downstream by the support lug 52*a*, and delivered onto the shift tray 202 by the discharge roller pair 6. The discharge sensor 303 provided near the discharge roller pair 6 detects whether a sheet stack has been output.

As shown in FIG. 6, when the stapling mode is selected, the jogger fence pair 53 is moved from its home position to a stand-by position at which each jogger fence 53 is away from a corresponding widthwise end of a sheet to be delivered onto the edge stapling tray F by 7 millimeters. When a sheet conveyed by the discharge roller pair 11 advances past the discharge sensor 305 at the trailing edge, the jogger fence 53 moves inward from the stand-by position by 5 millimeters and stops. The discharge sensor 305 detects passage of the trailing edge of the sheet, and supplies a detection signal to the CPU 360 (see FIG. 33). Upon receipt of the signal, the CPU 360 starts counting pulses supplied from the transport-to-stapler motor (not shown) that drives the discharge roller pair 11. When the pulse count reaches a predetermined number, the CPU 360 turns on the tapping SOL 170. Turning on and off the tapping SOL 170 causes the tapping roller 12 to swing. When the tapping SOL 170 is turned on, the tapping roller 12 taps a sheet to urge the sheet to return downward, thereby causing the sheet to abut against the trailing-edge fence 51 for alignment. Every time a sheet housed in the edge stapling tray F is conveyed past the entry sensor 301 or the discharge sensor 305, a signal indicating the passage is entered to the CPU 360, causing the CPU 360 to increment a sheet count by one.

After a lapse of a predetermined period of time since the tapping SOL 170 is turned off, the jogger motor 158 causes each jogger fence 53 to move further inward by 2.6 millimeters, and stop. Thus, widthwise alignment is completed. The jogger fence 53 is thereafter moved outward by 7.6 millimeters to return to the stand-by position, and waits for a subsequent sheet. This operation procedure is repeated up to the last page. Thereafter, each jogger fence 53 is moved inward by 7 millimeters and stopped to restrain the sheet stack at its opposite side ends as a preparation for stapling. Subsequently, after a lapse of predetermined period of time, the edge stapler S1 is driven by a staple motor (not shown) to staple the sheet stack. When stapling at two or more positions is specified, after stapling at a first position is completed, the stapler-moving motor 159 is driven to move the edge stapler S1 along the trailing edge of the sheet to an appropriate position corresponding to a second stapling position, at which the edge stapler S1 staples the sheet stack. This operation procedure is repeated when three or more stapling positions are specified.

After completion of the stapling, the delivery motor 157 is driven to rotate the delivery belt 52. In conjunction therewith, the sheet-output motors are also driven to cause the discharge roller pair 6 to start rotating to receive the stapled sheet stack lifted up by the support lug 52*a*. In conjunction therewith, the jogger fences 53 are controlled to perform an operation differently depending on a sheet size and the number of sheets to be stapled together. For example, when the number of sheets to be stapled together or the sheet size is smaller than a set value, the support lug 52*a* conveys the sheet stack, which is being press restrained by the jogger fences 53, by supporting the sheet stack at the trailing edge. When a predetermined number of pulses are detected by the sheet detecting sensor 310 or the HP sensor 311, the jogger fences 53 are retracted by 2 millimeters to release the sheet stack from restraint. The predetermined number of pulses is set to a time duration between a time when the support lug 52*a* comes into contact with the trailing edge of the sheet stack and a time when the sheet stack advances past the leading edges of the jogger fences 53. On the other hand, when the number of sheets to be stapled together or the sheet size is greater than the set value, the jogger fences 53 are retracted by 2 millimeters in advance, and then the sheet stack is delivered. In any case, at an instant when the stapled sheet stack has advanced past the jogger fences 53, each jogger fence 53 is further moved outward by 5 millimeters to return to the stand-by position to prepare for a subsequent sheet. Alternatively, a restraining force exerted on the sheet stack can be controlled by changing the distance of the jogger fences 53 with respect to a sheet.

(5) Center-Stapling-for-Booklet-Production Mode

FIG. 16 is a front view of the edge stapling tray F and the stapling/folding tray G. FIGS. 17 to 24 are schematic diagrams for explaining operations performed in the center-stapling-for-booklet-production mode.

With reference to FIG. 1, sheets are guided by the path-switching flaps 15 and 16 from the transport path A to the transport path D, and then delivered onto the edge stapling tray F shown in FIG. 16 by the transport roller pairs 7, 9, and 10, and the discharge roller pair 11. In the edge stapling tray F, the sheets sequentially delivered onto the tray F by the discharge roller pair 11 are aligned as in the case of the stapling mode described in (4). In other words, the same operation sequence as that performed in the stapling mode until stapling is performed (see FIG. 17).

Figure 18:
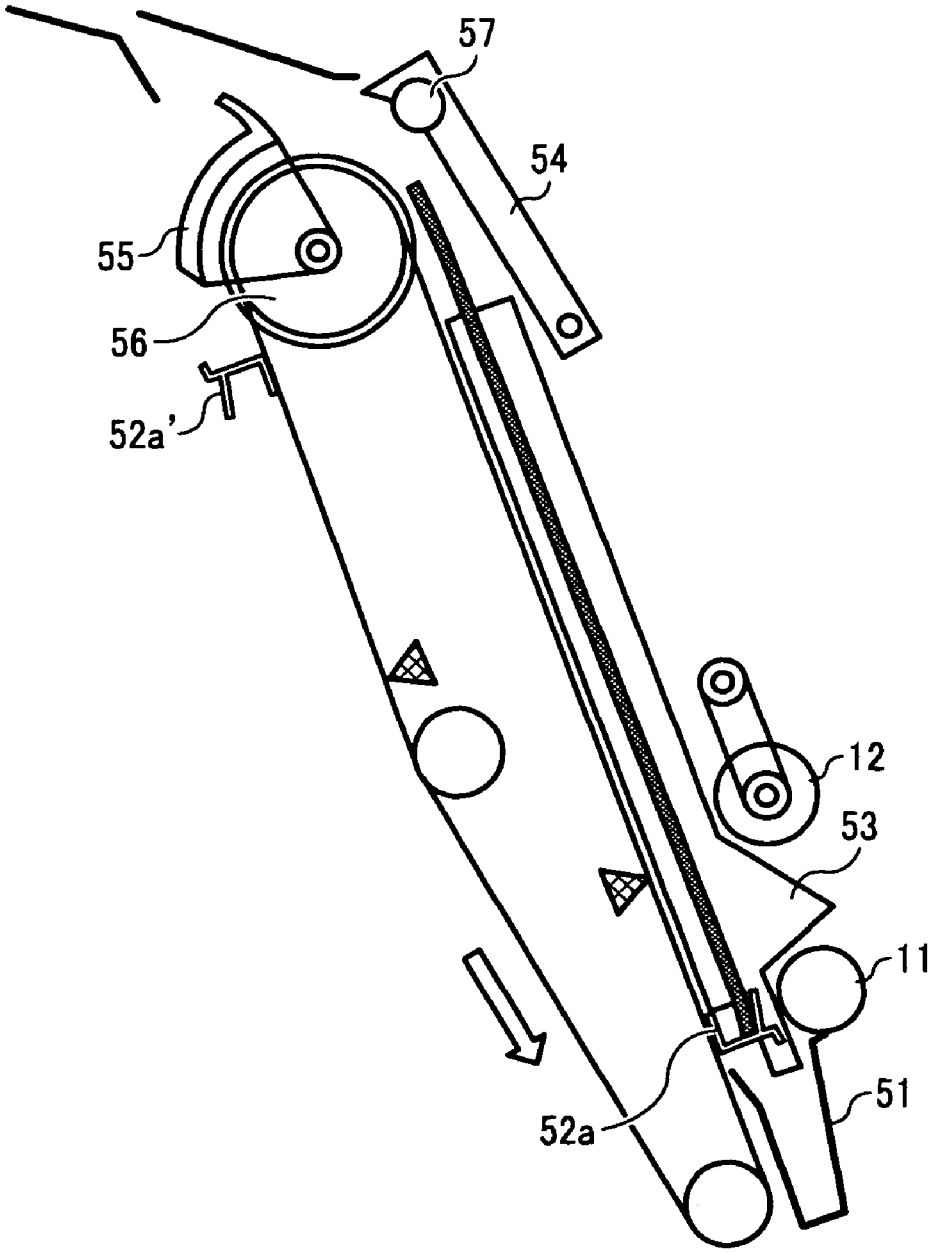
FIG. 18 is a schematic diagram for explaining how a sheet stack is to be conveyed from the stapling tray to the stapling/folding tray.
Figure 19:
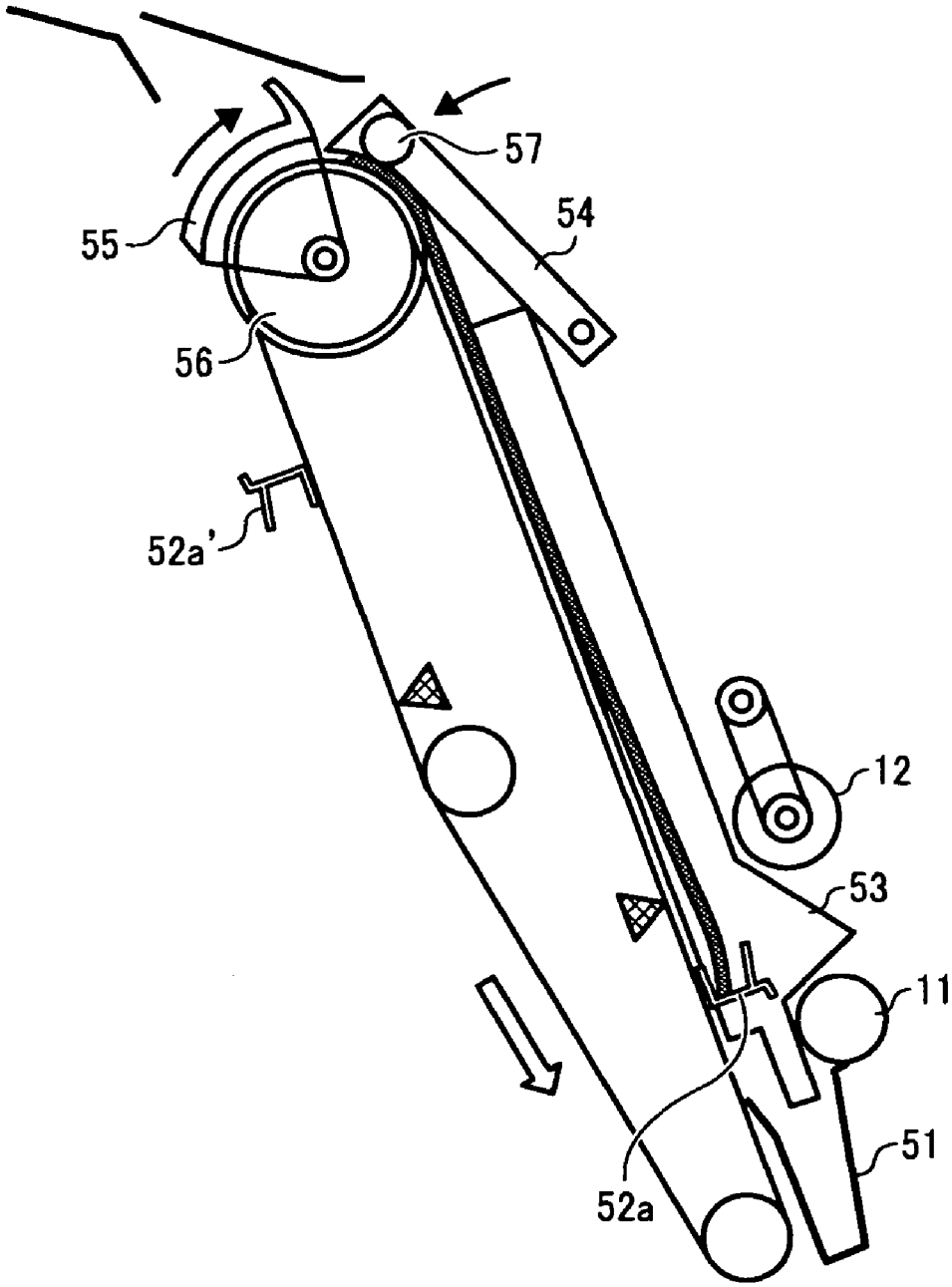
FIG. 19 is a schematic diagram for explaining how a sheet stack is to be steered and conveyed from the stapling tray to the stapling/folding tray.
Figure 20:
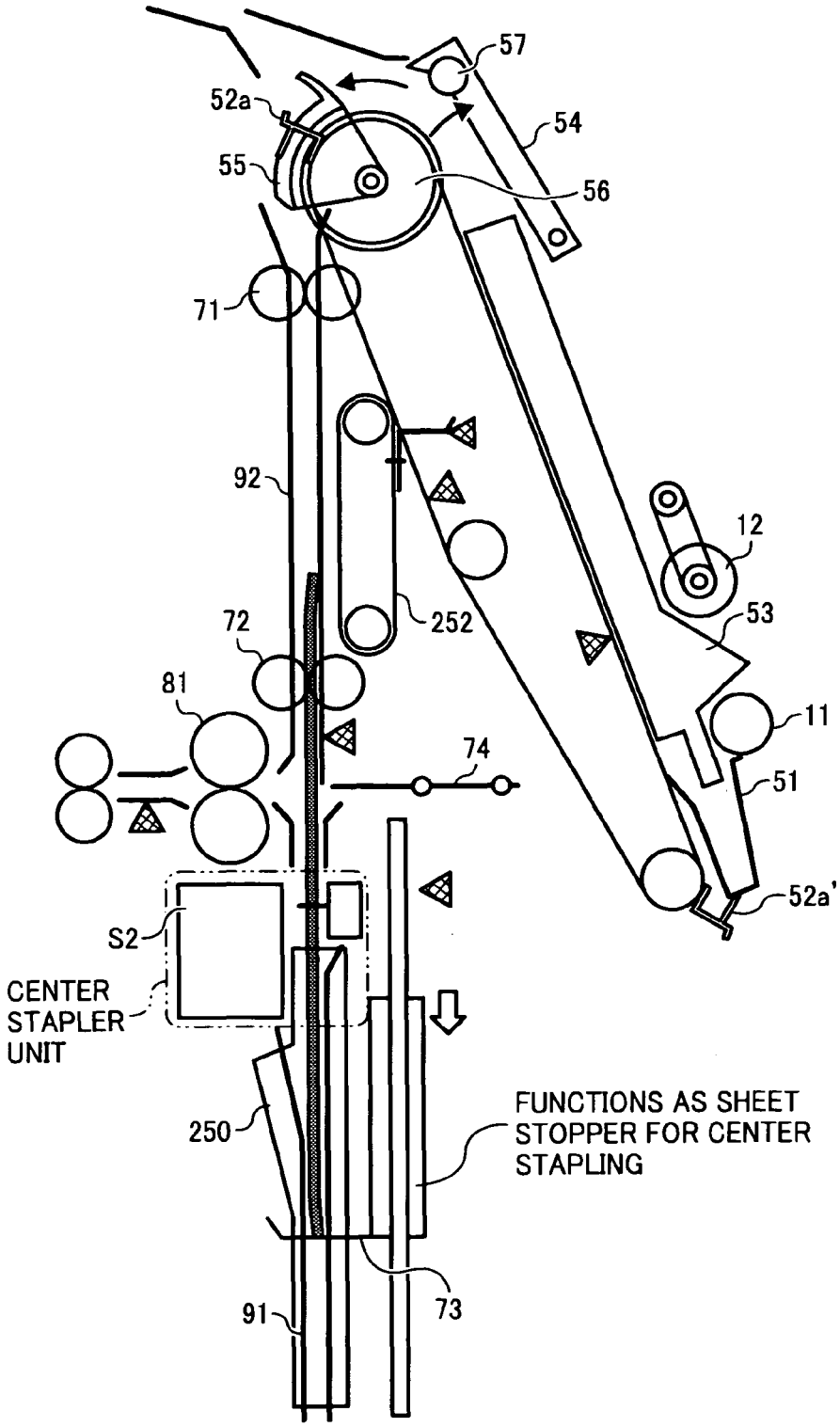
FIG. 20 is a schematic diagram for explaining a sheet stack conveyed from the stapling tray to the stapling/folding tray.

After being temporarily aligned in the edge stapling tray F, the sheets are lifted up by the support lug 52*a* as shown in FIG. 18. Thus, the sheets are nipped at its leading edge between the output rollers 56 and the pressing roller 57 as shown in FIG. 19. Subsequently, as described above, the switching guide 54 and the movable guide 55 are rotated to form a path to the stapling/folding tray G. The sheets are further conveyed by the support lug 52*a* and the output rollers 56 to the stapling/folding tray G via the thus-formed path. The output rollers 56 positioned on the drive shaft of the delivery belt 52 are driven in synchronism with the delivery belt 52.

Figure 21:
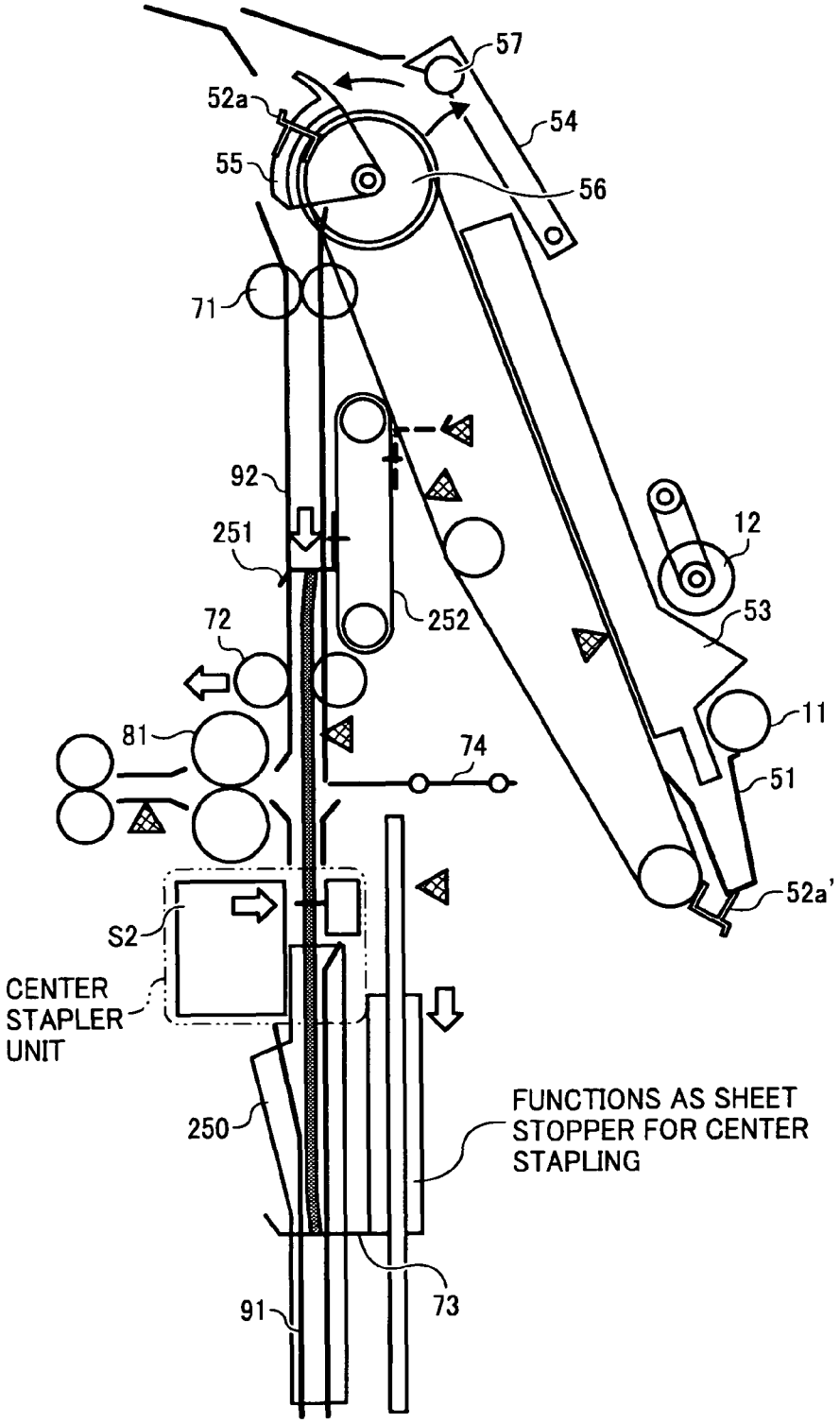
FIG. 21 is a schematic diagram for explaining a state where pressure applied by a transport roller pair is released, and a sheet stack is stopped by a movable fence and aligned in a sheet conveying direction by a tapping tab for center stapling.

Thereafter, the support lug 52*a* conveys the sheets until the trailing edge advances past the output rollers 56. Furthermore, the upper and lower transport-roller pairs 71 and 72 convey the sheets to the position shown in FIG. 20. Because the position at which the movable fence 73 is to be stopped is set to vary depending on sheet size in the sheet conveying direction, the movable fence 73 is on standby at a position corresponding to sheet size. When the sheets abut at the leading edge against the movable fence 73 at the standby position and are stacked, the pressure applied by the two rollers of the lower transport-roller pair 72 to each other is released as shown in FIG. 21, and the tapping tab 251 taps the sheets at the trailing edge, thereby performing final alignment in the conveying direction. Meanwhile, the jogger fences 250 positioned below the center stapler unit aligns the sheet stack in its widthwise direction. Thus, the sheet stack is aligned by the jogger fences 250 in the widthwise direction and by the movable fence 73 and the tapping tab 251 in the lengthwise direction (conveying direction), respectively.

In the aligning, a stopper (the movable fence 73) and the jogger fences 250 are forcibly pushed by a predetermined distance with respect to paper size (hereinafter, "push distance"). The distance is optimally changed based on size data, sheet-count data, and thickness data. When a stack of sheets is thick, allowance space in the transport paths is reduced, making it difficult to align the sheets in a single aligning. In this case, the aligning is performed repeatedly for an increased number of times, thereby attaining better alignment.

As the number of sheets increases, the longer period of time is required for stacking them sequentially upstream. This lengthens the time until the next stack. Accordingly, even when the aligning is performed more repeatedly, no loss is produced for the system in terms of time, but attains effective and favorable alignment. Thus, as a matter of course, by controlling the number of repetitions to perform the aligning depending on the period of time required by an upstream process, effective alignment can be attained.

Subsequently, the center stapler pairs S2 staple the sheet stack at its center (FIG. 21). Accordingly, the movable fence 73 positions the sheet stack such that the center stapler pairs S2 can staple the sheet stack at its center.

Figure 22:
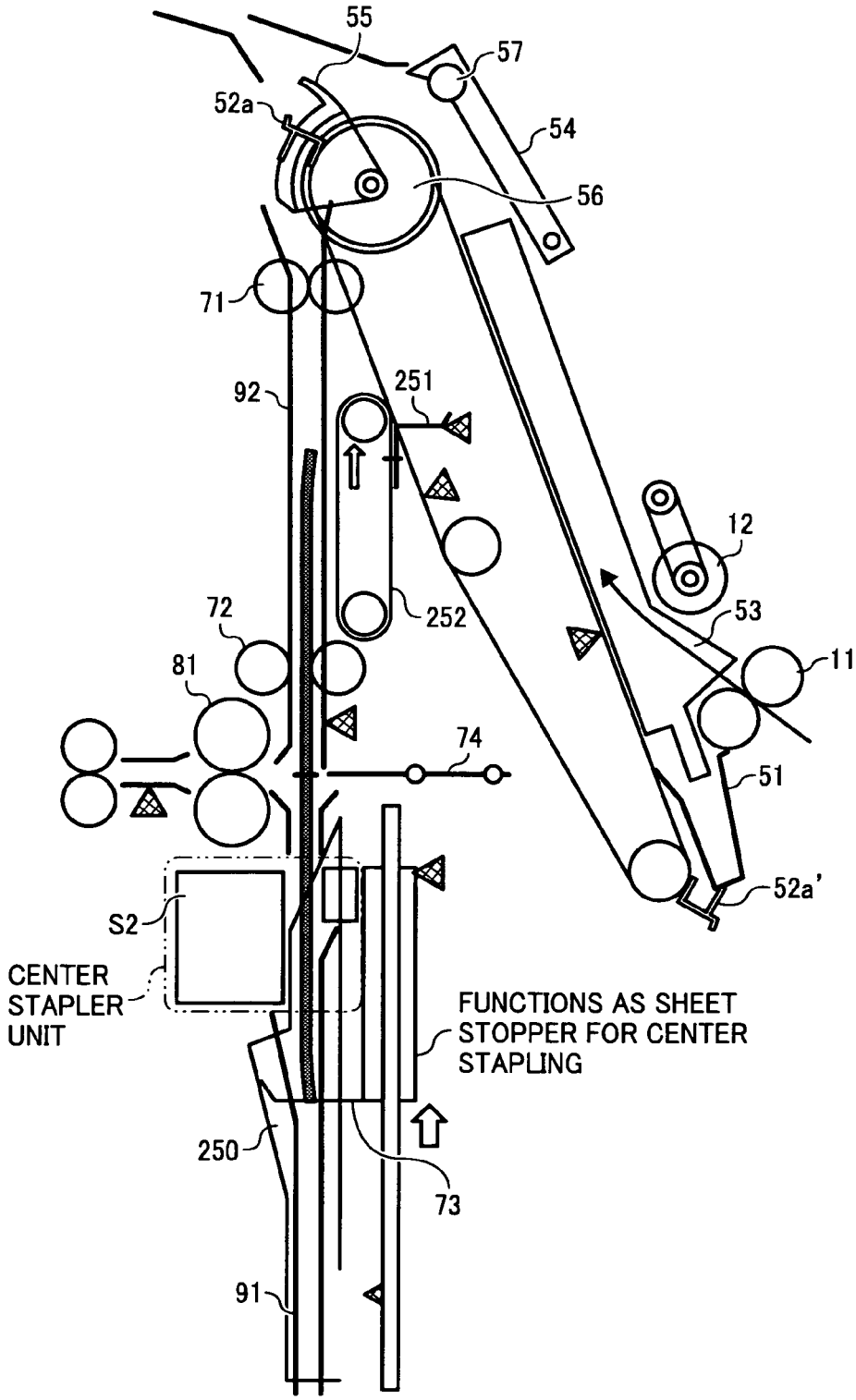
FIG. 22 is a schematic diagram for explaining a state where a sheet stack is lifted to a center-folding position after center stapling.
Figure 23:
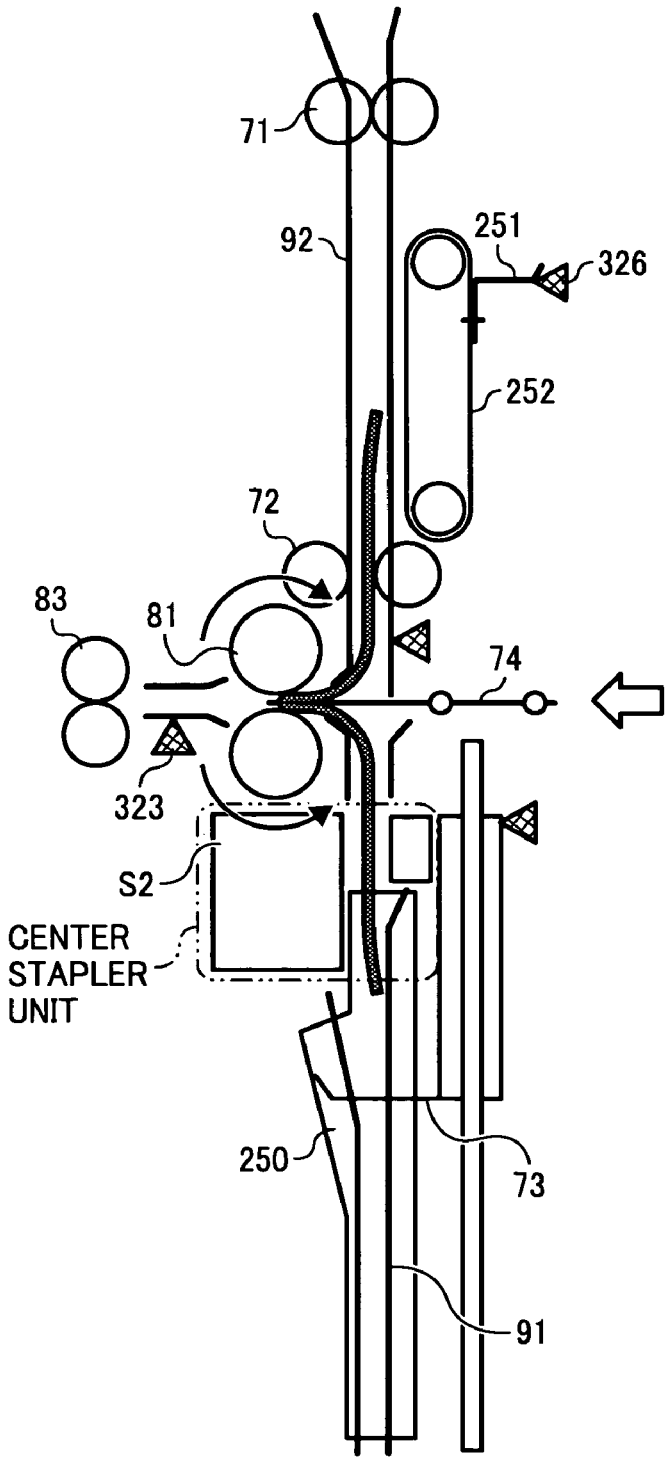
FIG. 23 is a schematic diagram for explaining operation of the folding plate that advances, after center stapling, to a sheet stack to push the sheet stack into a nip portion of a folding roller pair to fold the sheet stack.

The position of the movable fence 73 is determined based on pulses supplied from the movable HP sensor 322, and the position of the tapping tab 251 is determined based on pulses supplied from the HP sensor 326. As shown in FIG. 22, the center-stapled sheet stack is conveyed upward by the movement of the movable fence 73 to a position at which the folded portion faces a leading edge of the folding plate 74 with the pressure applied by the lower transport-roller pair 72 to each other remaining to be released. Subsequently, as shown in FIG. 23, the folding plate 74, pushes the sheet stack at the stapled portion or the proximity thereof toward the nip portion of the oppositely-positioned folding roller pair 81 in a direction essentially perpendicular to the sheet stack. The folding roller pair 81, having been rotated in advance, conveys the sheet stack while pressing it, thereby folding the sheet stack in two at its center.

Because the center-folded sheet stack to be subjected to folding is moved upward, the sheet stack can be conveyed without fail only by movement of the movable fence 73. If the sheet stack to be subjected to folding is moved downward, influences imparted by friction and static electricity make it uncertain whether the sheet stack follows the descending movement of the movable fence 73, which deteriorates reliability of conveyance. Accordingly, a method of conveying the sheet stack by descending the movable fence 73 requires another unit, such as another transport roller, which undesirably complicates the structure.

Figure 24:
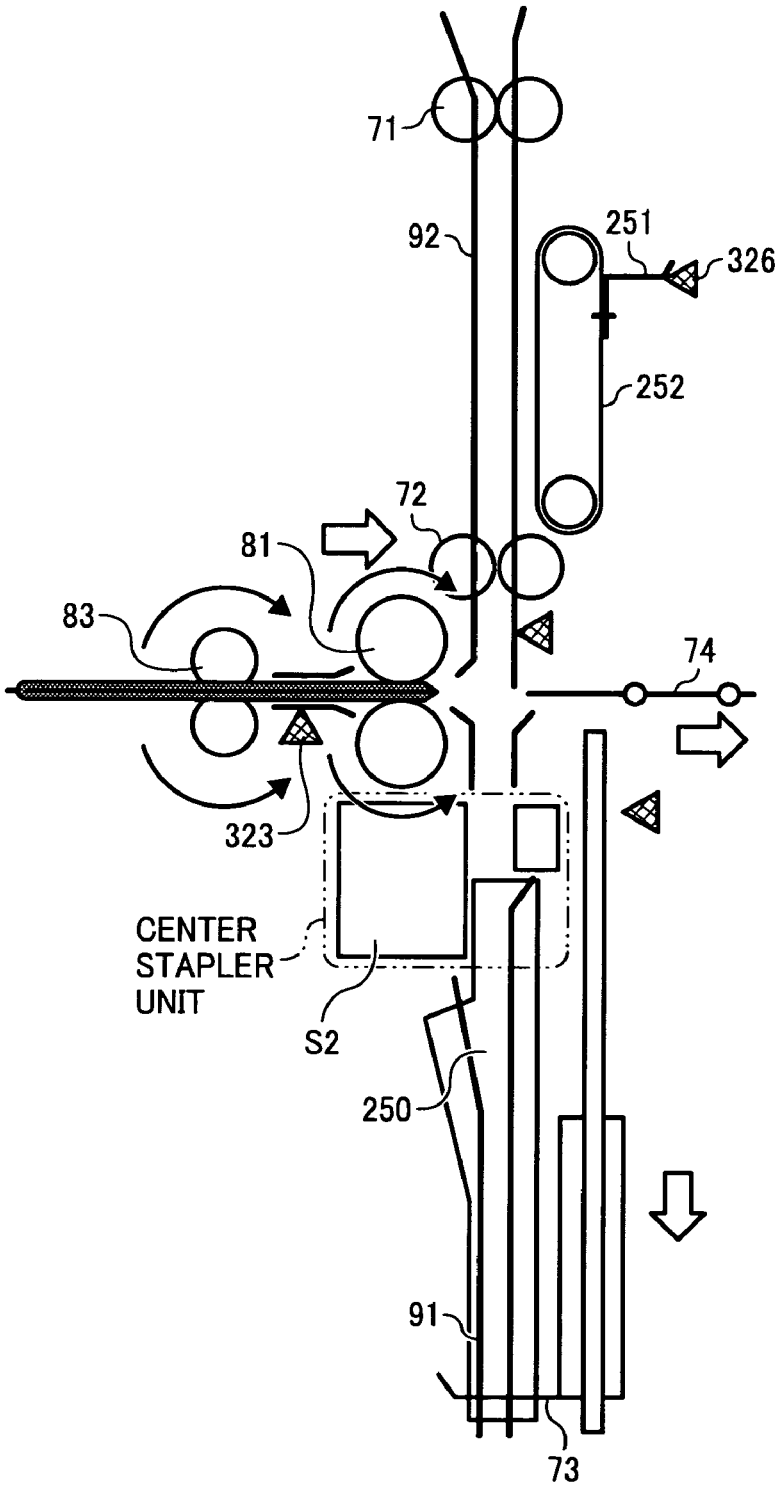
FIG. 24 is a schematic diagram for explaining a state where a sheet stack folded by the folding roller pair is output from an output roller.
Figure 25:
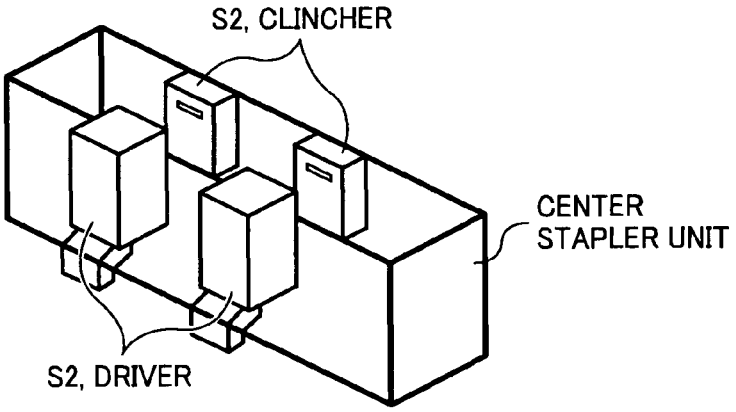
FIG. 25 is a perspective view of a center stapler unit.

As shown in FIG. 24, a discharge roller pair 83 delivers the folded sheet stack onto the lower tray 203. When the folded-portion passage sensor 323 detects passage of the trailing edge of the sheet stack, the folding plate 74 and the movable fence 73 are returned to their home positions, and the two rollers of the lower transport-roller pair 72 are also caused to press to each other. Thus, the sheet aligning device is returned to a state of being capable of conveying a sheet stack, thereby preparing for receipt of a subsequent sheet stack. When the size and the number of sheets of a subsequent job are equal to those in the current job, the movable fence 73 can alternatively move to the position shown in FIG. 20 again for standby.

Figure 26:
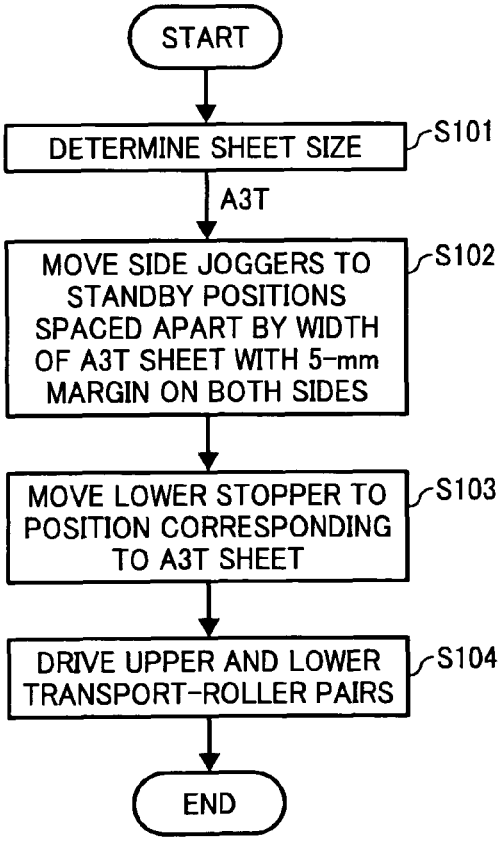
FIG. 26 is a flowchart of a preparation procedure for receiving of a sheet stack.
Figure 27:
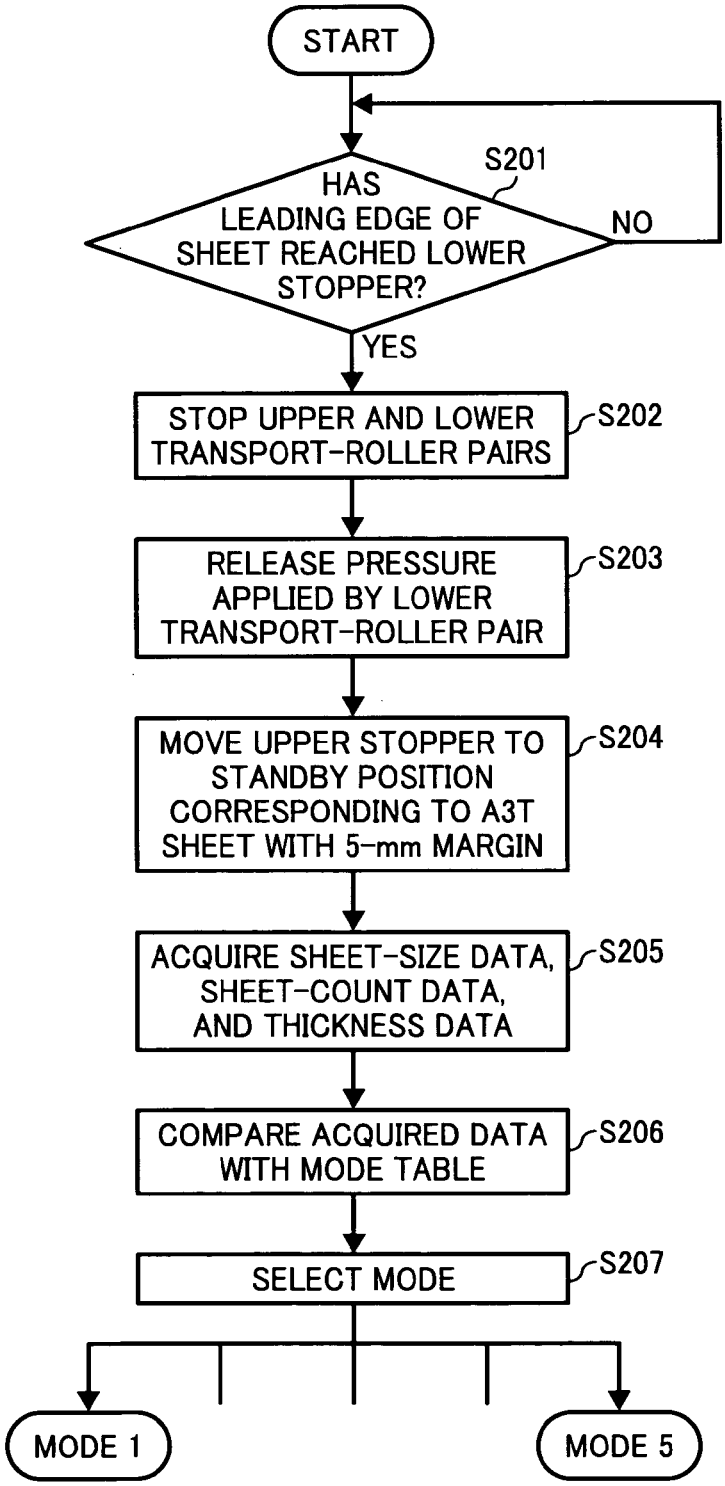
FIG. 27 is a flowchart of a process procedure for receiving a sheet stack.
Figure 28:
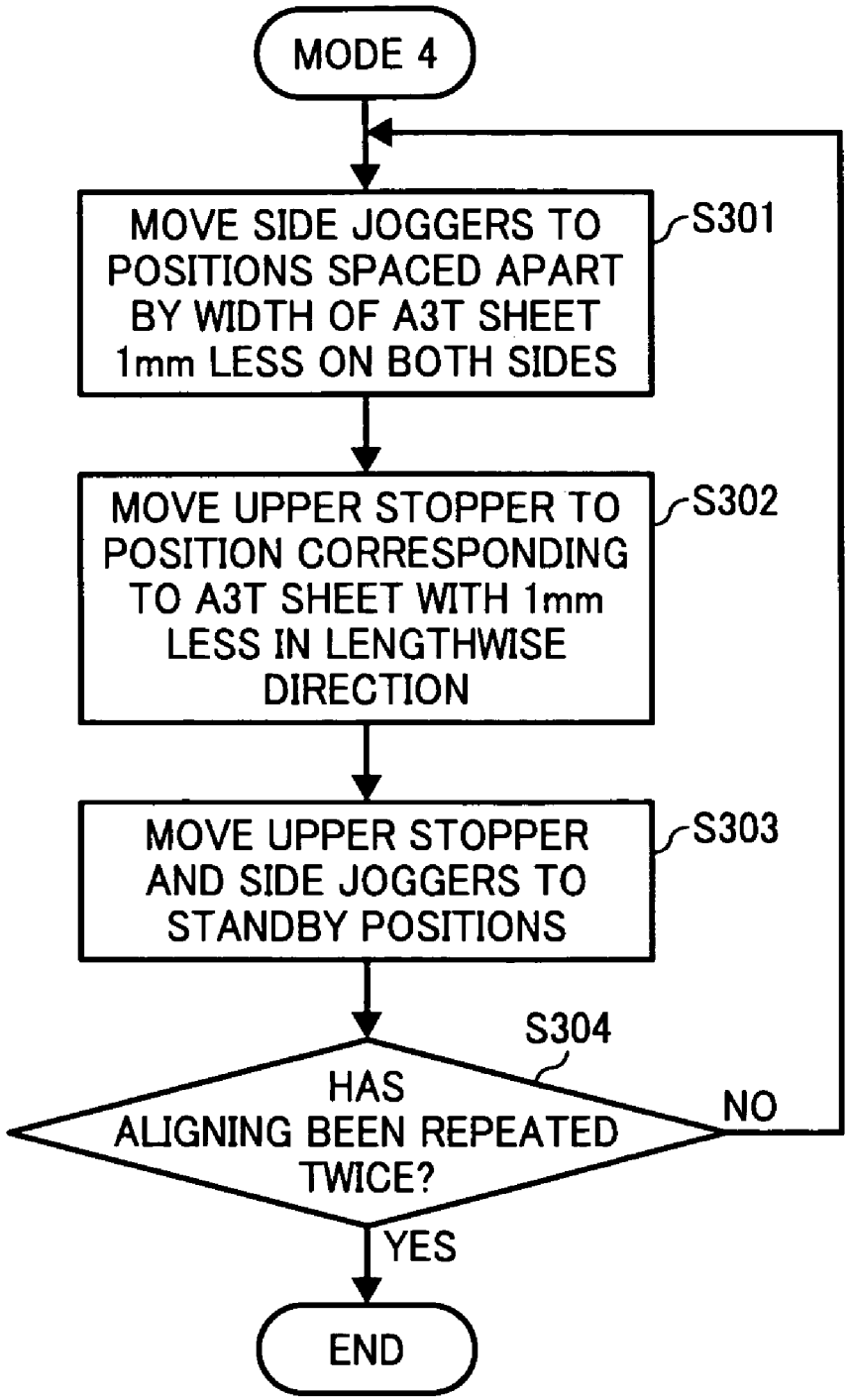
FIG. 28 is a flowchart of a process procedure performed in Mode 4.

FIGS. 26 to 28 are flowcharts of operations related to the movable fence 73 (stopper), and the jogger fences 250 (side joggers).

FIG. 26 is a flowchart of a preparation procedure for receiving A3 sheets. First, sheet size is determined (step S101). When sheet size is determined as A3 in portrait orientation (A3T), jogger fences 250 are moved to positions (standby position) spaced apart by a width of A3T sheet with a 5-millimeter margin on both sides (step S102). Subsequently, the movable fence 73 is moved to a position corresponding to A3T sheet in a lengthwise direction (step S103). The upper and lower transport-roller pairs 71 and 72 start rotating (step S104). Thus, the preparation procedure ends.

FIG. 27 is a flowchart of a process procedure for receiving the sheets after completion of the preparation procedure shown in FIG. 26. When the leading edge of a sheet reaches the stapling/folding tray G to abut against the movable fence 73 (YES at step S201), the upper and lower transport-roller pairs 71 and 72 are stopped (step S202), and the pressure applied by the lower transport-roller pair 72 to each other is released (step S203). Subsequently, the tapping tab 251 (in FIG. 27, "upper stopper") is moved to a position (standby position) corresponding to A3T sheet with a 5-millimeter margin in the lengthwise direction (step S204). Then, sheet-size data, sheet-count data, and thickness data are acquired (step S205). Each piece of the data is compared with data in mode tables shown in FIGS. 30 to 32 (step S206), and a mode is selected (step S207).

According to the mode table shown in FIG. 31, for a stack of 15 sheets in A3 size in thickness of 2 millimeters or less according to data acquired at step S205, Mode 4 is selected. In Mode 4, the push distance is 1 millimeter and the aligning process is performed twice. FIG. 28 is a flowchart of a process procedure performed in Mode 4. First, the jogger fences 250 are moved to positions spaced apart by a width of A3T sheet 1 millimeter less on both sides (step S301). The tapping tab 251 is moved to a position corresponding to A3T sheet with 1 millimeter less in the lengthwise direction (step S302). Thereafter, the jogger fences 250 and the tapping tab 251 are moved back to each standby position (step S303). This process procedure is repeated twice (step S304) to complete the aligning.

Thus, modes such as the number-of-aligning (FIG. 30), the push distance (FIG. 31), and the aligning task (FIG. 32) corresponding to various values of the sheet size, the number of sheets, and thickness of a sheet stack are set so that a sheet stack can be aligned in accordance with a selected one of the modes. The mode table shown in FIG. 29 is an example of classifying an aligning procedure into four modes that differ from each other only in the number of repetitions of the aligning to be performed by the jogger fences 250. The mode table shown in FIG. 30 is an example of classifying an aligning procedure into four modes that differ from each other in the distance to be pushed by the jogger fences 250 to deform sheets into four modes. Each mode table does not necessarily require the size data, the sheet-count data, and the thickness data. When detailed classification of the aligning task is not required, the modes can be set based on one or two of the conditions.

To align a sheet stack in a transport path having a limited space allowance, a stack of sheets which are in close contact with each other is caused to deform in the transport path so that air layers are included between each sheets to facilitate conveyance of the sheets, and eventually to attain alignment. Thus, it is theoretically possible to deform each sheet stack optimally by changing conditions, such as the sheet size, the number of sheets, and thickness of the sheet stack. A key element to attain the optimum deformation is the push distance as defined in the embodiment. When a sheet stack is deformed by a degree greater than that allowed in a limited space of the transport path, the sheet can be scratched, creased, or subjected to other damage. In addition, when a sheet stack is deformed by an excessive degree, the tapping tab 251 (stopper) and the jogger fences 250 (jogger) are overloaded, which can result in breakage of them. On the other hand, deforming a sheet stack by an insufficient degree can result in insufficient alignment of the sheet stack.

When, as in the embodiment, the push distances for the tapping tab 251 (stopper) and the jogger fences 250 (jogger) are set to optimum values in accordance size data, sheet-count data, and thickness data, sheets can be aligned in a vertical transport path.

When a stack of sheets is thick, allowance space in the transport path is reduced, making it difficult to align the sheets in a single aligning. In this case, the aligning is performed repeatedly for an increased number of times, thereby attaining better alignment.

As the number of sheets increases, the longer period of time is required for stacking them sequentially upstream. This lengthens the time until the next stack. Under such a state, even when the aligning is performed more repeatedly, no loss is produced for the system in terms of time, but effective and favorable alignment is attained. Thus, by controlling the number of repetitions to perform the aligning depending on the period of time required by an upstream process, effective alignment can be attained.

According to an embodiment of the invention, an optimum mode can be selected for aligning sheets based on sheet size, the number of sheets, and their thickness. Thus, sheets can be aligned appropriately irrespective of a condition of the sheets.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet aligning device, comprising:

a transport path configured to transport a stack of a plurality of sheets;

a first aligning unit configured to align the stacked plurality of sheets in a first direction in which the stack of sheets is transported on the transport path according to an alignment mode;

a second aligning unit configured to align the stacked plurality of sheets in a second direction perpendicular to the first direction on the transport path according to the alignment mode;

a thickness acquiring unit configured to acquire a thickness of the stack of sheets; and a mode control unit configured to determine the alignment mode, the alignment mode selected by the mode control unit from a plurality of aligning modes based on at least one property of the stack of sheets, the aligning modes each corresponding to one of a different alignment parameter value of an alignment parameter and a different combination of alignment parameter values of a plurality of alignment parameters, wherein the second aligning unit aligns the stacked plurality of sheets differently in one of the aligning modes than in at least one other of the aligning modes, and the at least one property of the stack of sheets includes at least one of a sheet size, a number of the stacked plurality of sheets, and the thickness of the stack of sheets.

2. The sheet aligning device according to claim 1, wherein the alignment parameter and at least one of the plurality of alignment parameters is one of a number of times the stacked plurality of sheets are aligned and a push distance, and the push distance is a distance by which the stacked plurality of sheets are pushed by at least one of the first and second aligning units during the aligning.

3. The sheet aligning device according to claim 1, wherein the thickness acquiring unit includes a transport roller pair that is located most upstream on the transport path; and a detecting unit configured to detect a width of a nip portion between the transport roller pair.

4. The sheet aligning device according to claim 1, wherein the first aligning unit includes a stopper configured to determine a position of leading edges of the stacked plurality of sheets; and a tapping member configured to tap trailing edges of the stacked plurality of sheets.

5. The sheet aligning device according to claim 4, wherein the stopper determines the position of the leading edges of the stacked plurality of sheets based on the size of the stacked plurality of sheets, and the tapping member taps a position on the trailing edges corresponding to the size of the stacked plurality of sheets.

6. The sheet aligning device according to claim 1, wherein the second aligning unit includes a jogger member that is configured to be brought into close contact with and separated from the stack of sheets in a sheet-width direction on a leading-edge side for aligning the stacked plurality of sheets.

7. The sheet aligning device according to claim 1, further comprising:

a stacker that is located upstream of the transport path, wherein the stacker is configured to stack the plurality of sheets for alignment by the first and second aligning units, the first and second aligning units downstream from the stacker.

8. The sheet aligning device according to claim 7, further comprising:

a guiding unit configured to guide the stacked plurality of sheets discharged from the stacker to the transport path.

9. The sheet aligning device according to claim 1, wherein the first aligning unit is configured to simultaneously align the stacked plurality of sheets to each other in the first direction, and the second aligning unit is configured to simultaneously align the stacked plurality of sheets to each other in the second direction.

10. The sheet aligning device according to claim 9, wherein the sheet aligning device is configured such that the first aligning unit aligns the stacked plurality of sheets at a same time as the second aligning unit.

11. A sheet processing device, comprising:

a sheet aligning device that includes a transport path configured to transport a stack of a plurality of sheets;

a first aligning unit configured to align the stacked plurality of sheets in a first direction in which the stack of sheets is transported on the transport path according to an alignment mode;

a second aligning unit configured to align the stacked plurality of sheets in a second direction perpendicular to the first direction on the transport path according to the alignment mode;

a thickness acquiring unit configured to acquire a thickness of the stack of sheets;

a mode control unit configured to determine the alignment mode, the alignment mode selected by the mode control unit from a plurality of aligning modes based on at least one property of the stack of sheets, the aligning modes each corresponding to one of a different alignment parameter value of an alignment parameter and a different combination of alignment parameter values of a plurality of alignment parameters; and a stapling unit that is located on the transport path for stapling the stacked plurality of sheets, wherein the second aligning unit aligns the stacked plurality of sheets differently in one of the aligning modes than in at least one other of the aligning modes, and the at least one property of the stack of sheets includes at least one of a sheet size, a number of the stacked plurality of sheets, and the thickness of the stack of sheets.

12. The sheet processing device according to claim 11, wherein the stapling unit is configured to staple a center of the stack of sheets.

13. The sheet processing device according to claim 12, further comprising:

a folding unit configured to fold the stack of sheets along a fold line near a position stapled by the stapling unit.

14. The sheet processing device according to claim 13, wherein the folding unit includes a folding roller pair; and a folding plate configured to contact a portion of the stack of sheets near the position stapled by the stapling unit to define the fold line, and to push the fold line of the stack of sheets into a nip portion of the folding roller pair to fold the stack of sheets along the fold line.

15. The sheet processing device according to claim 14, further comprising:

a stacker configured to stack the plurality of sheets folded by the folding unit.

16. An image forming apparatus, comprising:

a sheet aligning device that includes a transport path configured to transport one or more sheets;

a first aligning unit configured to align the one or more sheets in a first direction in which the one or more sheets are transported on the transport path according to an alignment mode;

a second aligning unit configured to align the one or more sheets in a second direction perpendicular to the first direction on the transport path according to the alignment mode; and a mode control unit configured to determine the alignment mode, the alignment mode selected by the mode control unit from a plurality of aligning modes based on at least one property of the one or more sheets, the aligning modes each corresponding to one of a different alignment parameter value of an alignment parameter and a different combination of alignment parameter values of a plurality of alignment parameters, wherein the second aligning unit aligns the one or more sheets differently in one of the aligning modes than in at least one other of the aligning modes, and the at least one property includes a thickness of the one or more sheets.

17. The image forming apparatus according to claim 16, further comprising:

a sheet processing device that includes the sheet aligning device and a stapling unit; the stapling unit located on the transport path and configured to staple the one or more sheets.

18. A sheet aligning device, comprising:

a transport path configured to transport a stack of a plurality of sheets;

a first aligning unit configured to align the stacked plurality of sheets in a first direction in which the stack of sheets is transported on the transport path according to an alignment mode;

a second aligning unit configured to align the stacked plurality of sheets in a second direction perpendicular to the first direction on the transport path according to the alignment mode; and a mode control unit configured to determine the alignment mode, the alignment mode selected by the mode control unit from a plurality of aligning modes based on at least one property of the stack of sheets, the aligning modes each corresponding to one of a different alignment parameter value of an alignment parameter and a different combination of alignment parameter values of a plurality of alignment parameters, wherein the second aligning unit aligns the stacked plurality of sheets differently in one of the aligning modes than in at least one other of the aligning modes, the first aligning unit is configured to simultaneously align the stacked plurality of sheets to each other in the first direction, the second aligning unit is configured to simultaneously align the stacked plurality of sheets to each other in the second direction, and the sheet aligning device is configured such that the first aligning unit aligns the stacked plurality of sheets at a same time as the second aligning unit.

19. A sheet aligning device, comprising:

a transport path configured to transport a stack of a plurality of sheets;

a first aligning unit configured to align the stacked plurality of sheets in a first direction in which the stack of sheets is transported on the transport path according to an alignment mode;

a second aligning unit configured to align the stacked plurality of sheets in a second direction perpendicular to the first direction on the transport path according to the alignment mode; and a mode control unit configured to determine the alignment mode, the alignment mode selected by the mode control unit from a plurality of aligning modes based on at least one property of the stack of sheets, the aligning modes each corresponding to one of a different alignment parameter value of an alignment parameter and a different combination of alignment parameter values of a plurality of alignment parameters, wherein the second aligning unit aligns the stacked plurality of sheets differently in one of the aligning modes than in at least one other of the aligning modes, the first aligning unit includes a stopper configured to determine a position of leading edges of the stacked plurality of sheets, and a tapping member configured to tap trailing edges of the stacked plurality of sheets, the stopper determines the position of the leading edges of the stacked plurality of sheets based on a size of the stacked plurality of sheets, and the tapping member taps a position on the trailing edges corresponding to the size of the stacked plurality of sheets.

* * * * *